US012624899B2

(12) United States Patent
Nakaharai et al.

(10) Patent No.: US 12,624,899 B2
(45) Date of Patent: May 12, 2026

(54) HEAT EXCHANGER CORE, HEAT EXCHANGER, MAINTENANCE METHOD FOR HEAT EXCHANGER CORE, AND PRODUCING METHOD FOR HEAT EXCHANGER CORE

(71) Applicant: MITSUBISHI HEAVY INDUSTRIES, LTD., Tokyo (JP)

(72) Inventors: Hiroyuki Nakaharai, Tokyo (JP); Koichi Tanimoto, Tokyo (JP); Yoichi Uefuji, Tokyo (JP); Nobuhide Hara, Tokyo (JP); Takuo Oda, Tokyo (JP); Masaya Hatanaka, Tokyo (JP); Shunsaku Eguchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 819 days.

(21) Appl. No.: 17/798,225

(22) PCT Filed: Feb. 24, 2021

(86) PCT No.: PCT/JP2021/006753
§ 371 (c)(1),
(2) Date: Aug. 8, 2022

(87) PCT Pub. No.: WO2021/172318
PCT Pub. Date: Sep. 2, 2021

(65) Prior Publication Data

US 2023/0123794 A1 Apr. 20, 2023

(30) Foreign Application Priority Data

Feb. 27, 2020 (JP) ..... 2020-031252

(51) Int. Cl.
*F28D 9/00* (2006.01)

(52) U.S. Cl.
CPC ..... *F28D 9/0062* (2013.01)

(58) Field of Classification Search
CPC ..... F28D 9/0062; F28D 9/0087
See application file for complete search history.

(56) References Cited

U.S. PATENT DOCUMENTS 6,250,380 B1 * 6/2001 Strahle ..... F28D 9/0043 165/166
6,364,007 B1 * 4/2002 Fischer ..... F28D 9/0037 165/170

(Continued)

FOREIGN PATENT DOCUMENTS

CN 204830955 U 12/2015
CN 110530190 A 12/2019

(Continued)

OTHER PUBLICATIONS

International Preliminary Report on Patentability and Written Opinion of the International Searching Authority for International Application No. PCT/JP2021/006753, dated Sep. 9, 2022, with a English translation.

(Continued)

*Primary Examiner* — Kristina N Junge
(74) *Attorney, Agent, or Firm* — Birch, Stewart, Kolasch & Birch, LLP

(57) ABSTRACT

A heat exchanger core according to at least one embodiment is provided with: a core body having a plurality of cavity portions forming a plurality of channels inside the core body; and a header including a header passage communicating with the plurality of channels on at least one end side of the core body. The header passage is at least partially located in a region displaced outward from an arrangement area of the plurality of channels in plan view as viewed from a first extension direction of the plurality of channels. The core body has a body side surface extending along the first (Continued)

extension direction at a position closer to the arrangement area than a portion of the header passage that is farthest outward from the arrangement area in the plan view.

12 Claims, 16 Drawing Sheets

(56) References Cited

U.S. PATENT DOCUMENTS

| | | | | |
|---|---|---|---|---|
| 10,809,007 | B2 * | 10/2020 | Martinez | F28D 7/0033 |
| 10,962,252 | B2 * | 3/2021 | LePoudre | F24F 3/147 |
| 11,226,158 | B2 * | 1/2022 | Streeter | F28F 7/02 |
| 11,255,615 | B2 * | 2/2022 | Streeter | F28F 9/0246 |
| 11,384,992 | B2 * | 7/2022 | Suzuki | F28D 9/00 |
| 12,038,235 | B2 * | 7/2024 | Kaneko | F28D 1/05391 |
| 2010/0051248 | A1 * | 3/2010 | Inatomi | F28D 9/0037 165/166 |
| 2014/0231057 | A1 * | 8/2014 | Schalansky | F28F 9/02 165/169 |
| 2017/0089643 | A1 * | 3/2017 | Arafat | F28D 9/0037 |
| 2022/0252352 | A1 * | 8/2022 | Iida | B33Y 80/00 |
| 2022/0290924 | A1 | 9/2022 | Eguchi et al. | |

FOREIGN PATENT DOCUMENTS

| | | | |
|---|---|---|---|
| JP | 3406896 | B2 | 5/2003 |
| JP | 2009-281696 | A | 12/2009 |
| JP | 2018-122521 | A | 8/2018 |
| JP | 2018-204861 | A | 12/2018 |
| JP | 2021-38894 | A | 3/2021 |

OTHER PUBLICATIONS

International Search Report for International Application No. PCT/JP2021/006753, dated Apr. 6, 2021.

Chinese Office Action and Search Report for Chinese Application No. 202180014738.1, dated Feb. 22, 2025, with English translation.

* cited by examiner

HEAT EXCHANGER CORE, HEAT EXCHANGER, MAINTENANCE METHOD FOR HEAT EXCHANGER CORE, AND PRODUCING METHOD FOR HEAT EXCHANGER CORE

TECHNICAL FIELD

The present disclosure relates to a heat exchanger core, a heat exchanger, a maintenance method for a heat exchanger core, and a producing method for a heat exchanger core.

The present application claims priority based on Japanese Patent Application No. 2020-031252 filed Feb. 27, 2020, the entire content of which is incorporated herein by reference.

BACKGROUND ART

Heat exchangers are used in various devices, plants, etc., for the purpose of heating or cooling fluids. There are various types of heat exchangers; for example, a heat exchanger in which a heat exchanger core composed of a laminate of plates is housed inside a cylindrical casing is known (Patent Document 1).

CITATION LIST

Patent Literature

Patent Document 1: JP3406896B

SUMMARY

Problems to be Solved

However, when a heat exchanger core is formed by stacking plates as in Patent Document 1, the shape of the heat exchanger core is inevitably restricted. In response to this, in recent years, a heat exchanger has been manufactured by additive manufacturing. By producing the heat exchanger by additive manufacturing, it is possible to significantly reduce the constraints on the shape of the heat exchanger core.

However, if the overall shape of the heat exchanger core is a simple pillar shape, for example, there will be excess areas that do not contribute to the strength and heat exchange efficiency of the heat exchanger core, resulting in an increase in the weight of the heat exchanger core and the manufacturing cost.

In view of the above, an object of at least one embodiment of the present disclosure is to provide a heat exchanger core that has a reasonable shape.

Solution to the Problems (1) A heat exchanger core according to at least one embodiment of the present disclosure is provided with: a core body having a plurality of cavity portions forming a plurality of channels inside the core body; and a header including a header passage communicating with the plurality of channels on at least one end side of the core body. The header passage is at least partially located in a region displaced outward from an arrangement area of the plurality of channels in plan view as viewed from a first extension direction of the plurality of channels. The core body has a body side surface extending along the first extension direction at a position closer the arrangement area than a portion of the header passage that is farthest outward from the arrangement area in the plan view.

(2) A heat exchanger according to at least one embodiment of the present disclosure is provided with: at least one heat exchanger core having the configuration (1); and a housing to which the at least one heat exchanger core is attached.

(3) A maintenance method for a heat exchanger according to at least one embodiment of the present disclosure is a maintenance method for a heat exchanger provided with: at least one heat exchanger core having the configuration (1) or (2); and a housing to which the at least one heat exchanger core is attached, including: a step of holding the heat exchanger core by a jig; a step of inserting the heat exchanger core held by the jig into a mounting portion for the heat exchanger core in the housing together with the jig; and a step of removing the jig from the mounting portion while the heat exchanger core inserted in the mounting portion is left in the mounting portion. The step of holding the heat exchanger core by the jig includes holding the heat exchanger core while supporting the body side surface from the side by the jig.

(4) A producing method for a heat exchanger according to at least one embodiment of the present disclosure includes: a step of forming a core body having a plurality of cavity portions forming a plurality of channels inside the core body by additive manufacturing; and a step of forming a header including a header passage communicating with the plurality of channels on at least one end side of the core body by additive manufacturing. The step of forming the header includes forming the header passage such that the header passage is at least partially located in a region displaced outward from an arrangement area of the plurality of channels in plan view as viewed from a first extension direction of the plurality of channels. The step of forming the core body includes forming the core body such that the core body has a body side surface extending along the first extension direction at a position closer to the arrangement area than a portion of the header passage that is farthest outward from the arrangement area in the plan view.

Advantageous Effects

At least one embodiment of the present disclosure provides a heat exchanger core that has a reasonable shape.

DETAILED DESCRIPTION

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Overall Configuration of Heat Exchanger Core)

Figure 1:
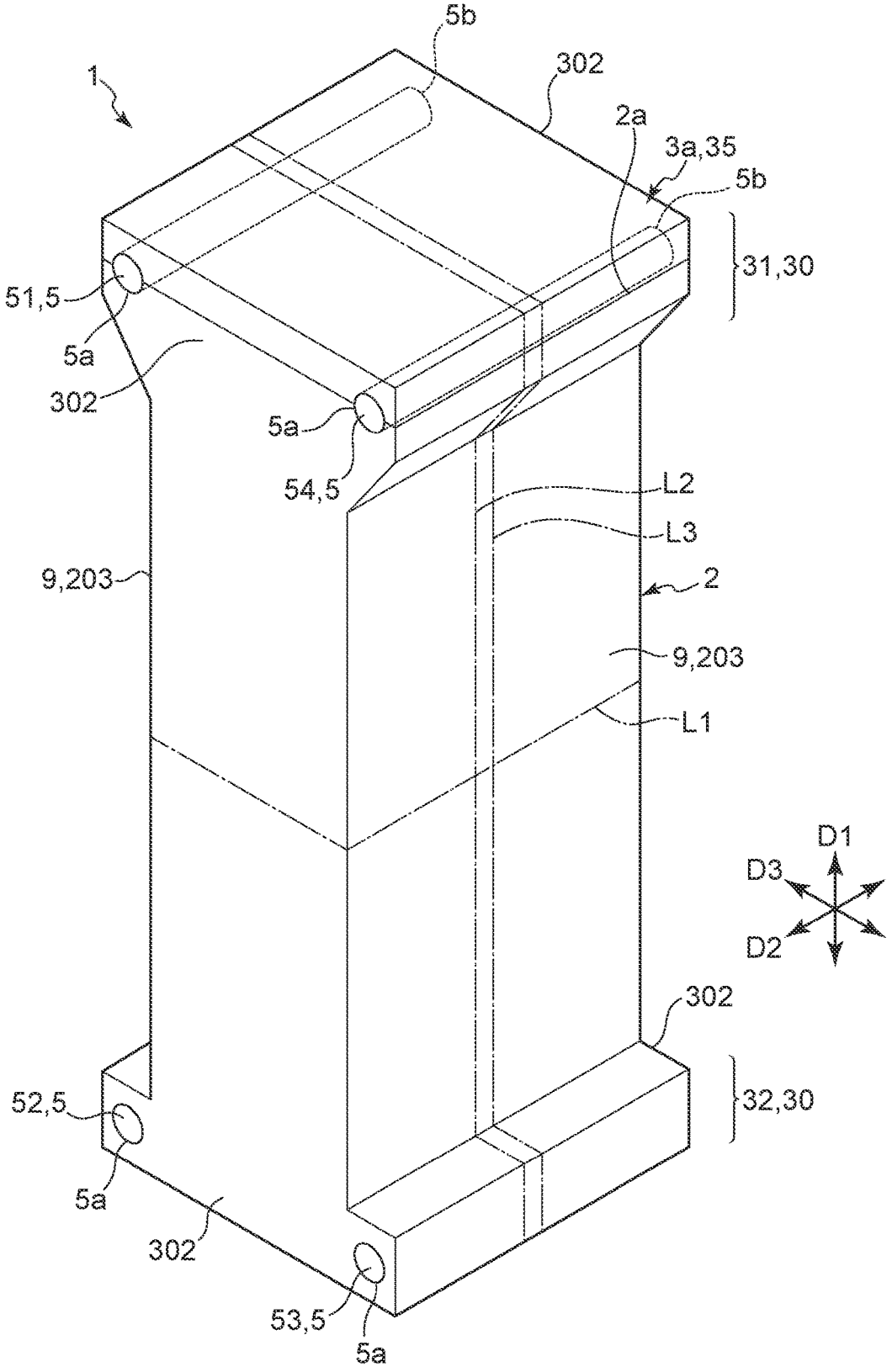
FIG. 1 is a schematic perspective view of a heat exchanger core according to some embodiments.

FIG. 1 is a schematic perspective view of a heat exchanger core according to some embodiments.

As shown in FIG. 1, the heat exchanger core 1 according to some embodiments is a heat exchanger core for exchanging heat between a first fluid and a second fluid, and includes a core body 2 having a plurality of cavity portions 40 forming a plurality of channels 4 inside the core body 2, and headers 30 each including a header passage 5 communicating with the plurality of channels 4 on one and the other end sides of the core body 2. The first fluid and the second fluid may each be a liquid or a gas, but the temperatures of both are usually different. Although not limited, the core body 2 can have a rectangular cuboid shape. In the case where the core body 2 has a rectangular cuboid shape, the headers 30 may be provided on one end side and the other end side along one of three mutually orthogonal axes of the core body 2. In the example shown in FIG. 1, the headers 30 are provided on one end side and the other end side in the longitudinal direction of the core body 2.

In the following description, the plurality of channels 4 are assumed to extend along a direction connecting one header 30 and the other header 30 (the longitudinal direction). Further, in the following description, the direction connecting one header 30 and the other header 30, i.e., the extension direction of the plurality of channels 4 is referred to as a first extension direction D1 or a first direction D1. Further, in the following description, one header 30 on the upper side in FIG. 1 is also referred to as a first header 31, and the other header 30 on the lower side in FIG. 1 is also referred to as a second header 32.

That is, in some embodiments, the header 30 includes a first header 31 including a header passage 5 that communicates with the plurality of channels 4 on one end side of the core body 2, and a second header including a header passage 5 that communicates with the plurality of channels 4 on the other end side of the core body 2.

In the following description, when it is not necessary to distinguish between the first header 31 and the second header 32, there are simply referred to as the header 30.

In the heat exchanger core 1 according to some embodiments, a rectangular lid member 3*a*, which is a covering member, may be attached to the first header 31 from the outside along the first extension direction D1. The lid member 3*a* may be detachably attached to the first header 31 by fastening with bolts or the like, or may be irreversibly attached by welding or with adhesive or the like.

In the heat exchanger core 1 according to some embodiments, the lid member 3*a* may be formed integrally with the first header 31.

Similarly, a lid member (not shown) formed separately from the second header 32 may be attached to the second header 32, or a part corresponding to the lid member may be formed integrally with the second header 32.

Figure 2:
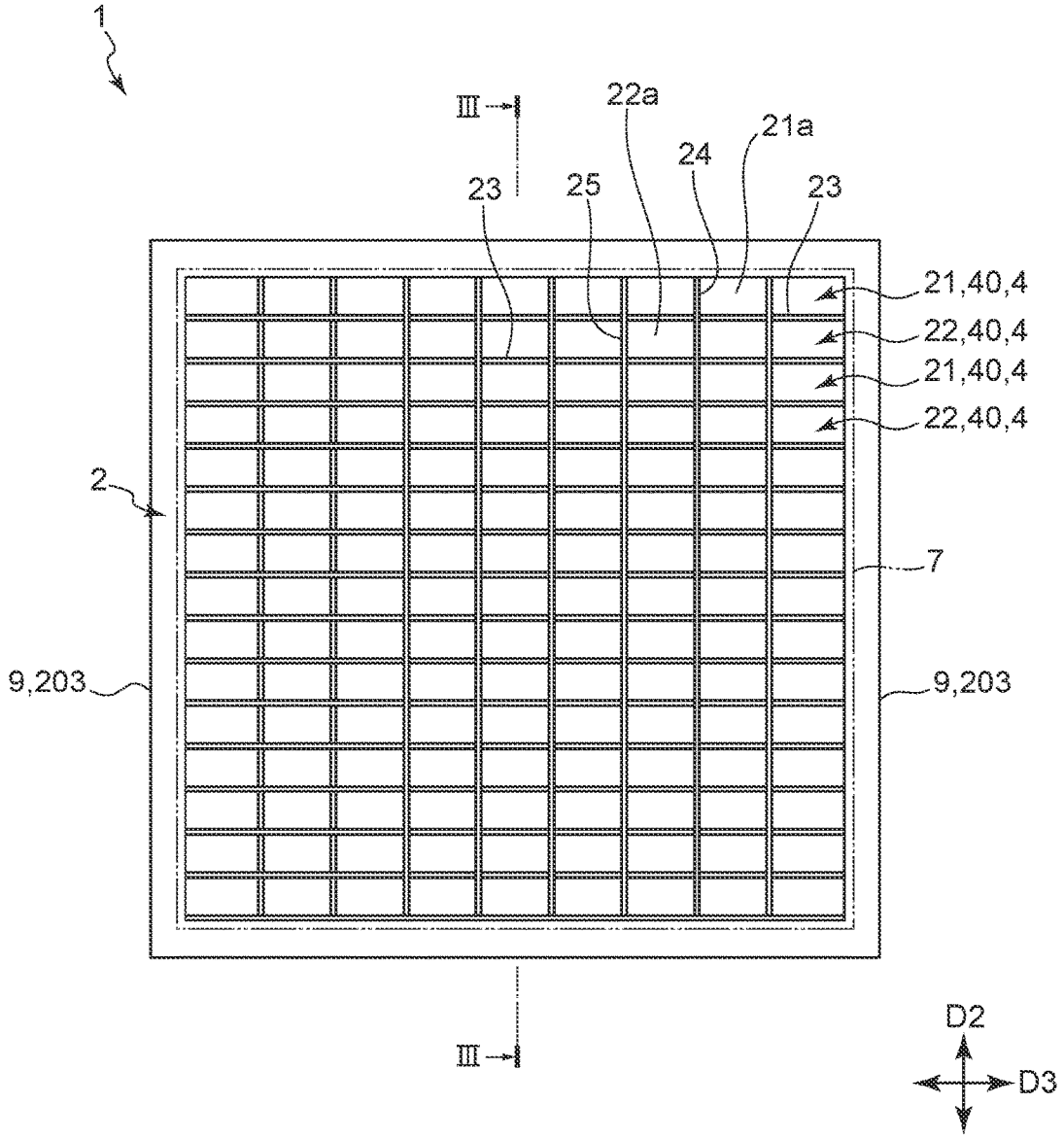
FIG. 2 is an end view of a section cut along the dotted line L1 of FIG. 1.

FIG. 2 is an end view of a cross-section cut along the dotted line L1 of FIG. 1.

As shown in FIG. 2, the plurality of channels 4 formed in the core body 2 includes first channels 21 through which the first fluid flows and second channels 22 through which the second fluid flows. The first channels 21 and the second channels 22 are each formed so as to extend along the first direction D1 which is the longitudinal direction of the core body 2 (the direction perpendicular to the paper in FIG. 2). The first channels 21 and the second channels 22 are alternately arranged in the direction perpendicular to the longitudinal direction of the core body 2 (a second extension direction D2, which will be described later). The first channel 21 and the second channel 22 that are adjacent to each other are separated by a partition wall 23. The numbers of first channels 21 and second channels 22, that is, the number of partition walls 23 is not limited to the number shown in FIG. 2, and can be designed to any number.

Although not an essential configuration, each first channel 21 and each second channel 22 may be divided into a plurality of divided channels 21*a* and a plurality of divided channels 22*a* by a plurality of dividing walls 24, 25, respectively. In this case, the numbers of divided channels 21*a* and 22*a*, that is, the number of dividing walls 25 is not limited to the number shown in FIG. 2, and can be designed to any number.

Figure 3:
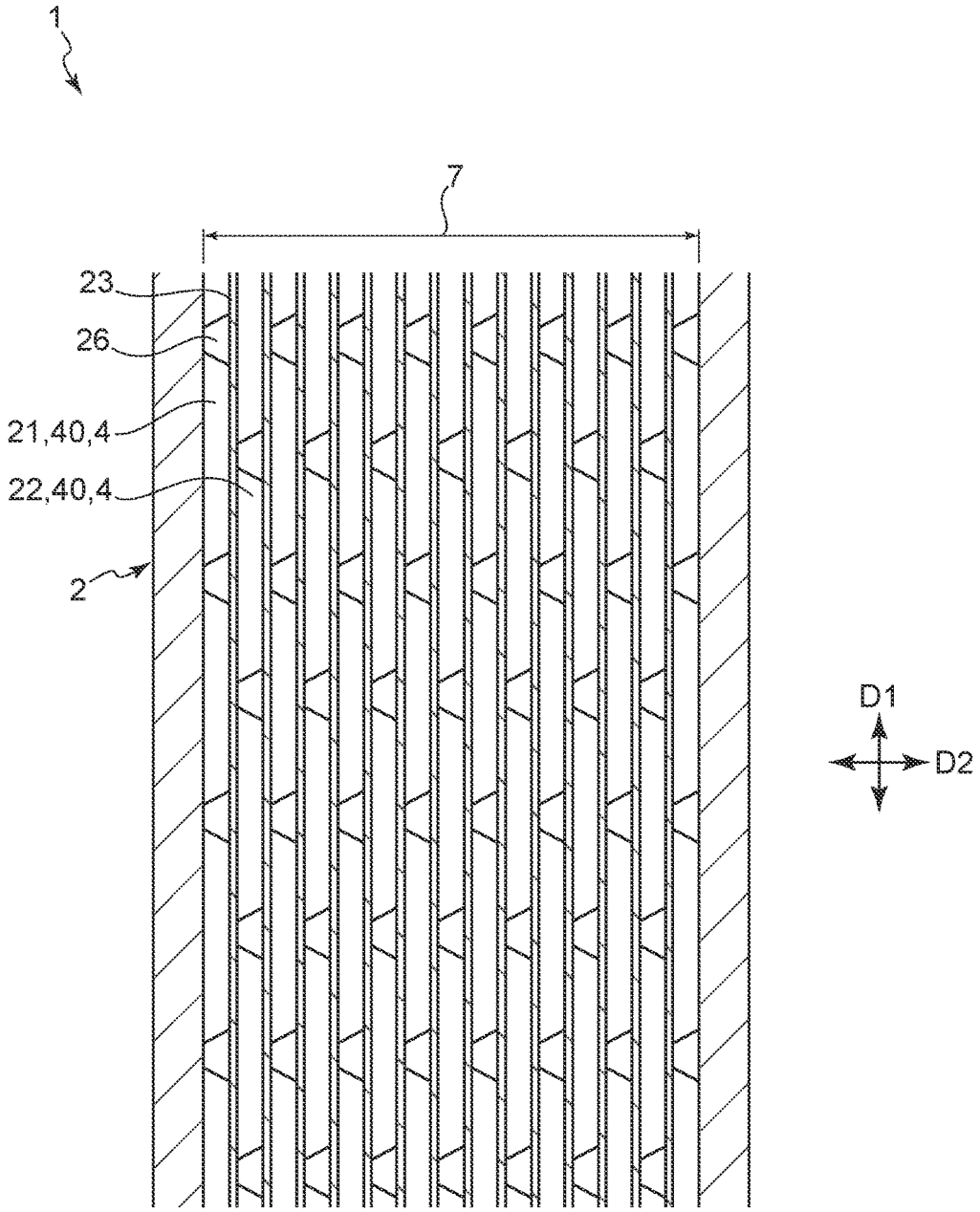
FIG. 3 is a cross-sectional view taken along line of FIG. 2.

FIG. 3 is a cross-sectional view taken along line in FIG. 2. Although the configuration shown in FIG. 3 is also not essential, each first channel 21 and each second channel 22 may be provided with one or more ribs 26 so as to extend between adjacent partition walls 23, 23.

Figure 4:
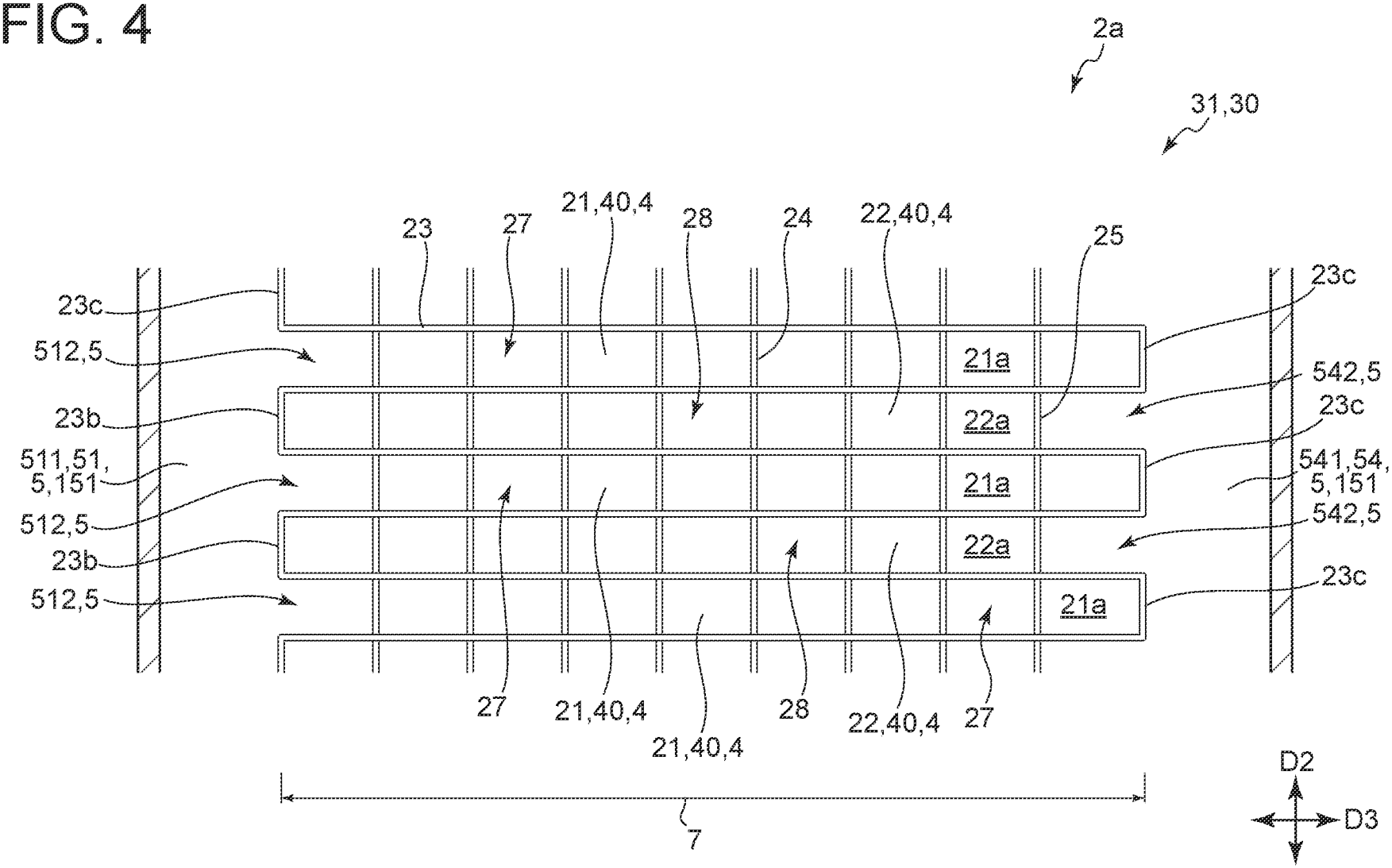
FIG. 4 is a plan view of a portion of an end surface of a core body when a lid member is detached from the heat exchanger core of FIG. 1.

FIG. 4 is a plan view of a portion of an end surface of the core body 2 when the lid member 3*a* is detached from the heat exchanger core 1 of FIG. 1, and shows an internal configuration of the first header 31. Although detailed description is omitted, the internal configuration of the second header 32 is the same as the internal configuration of the first header 31 described below.

Figure 5:
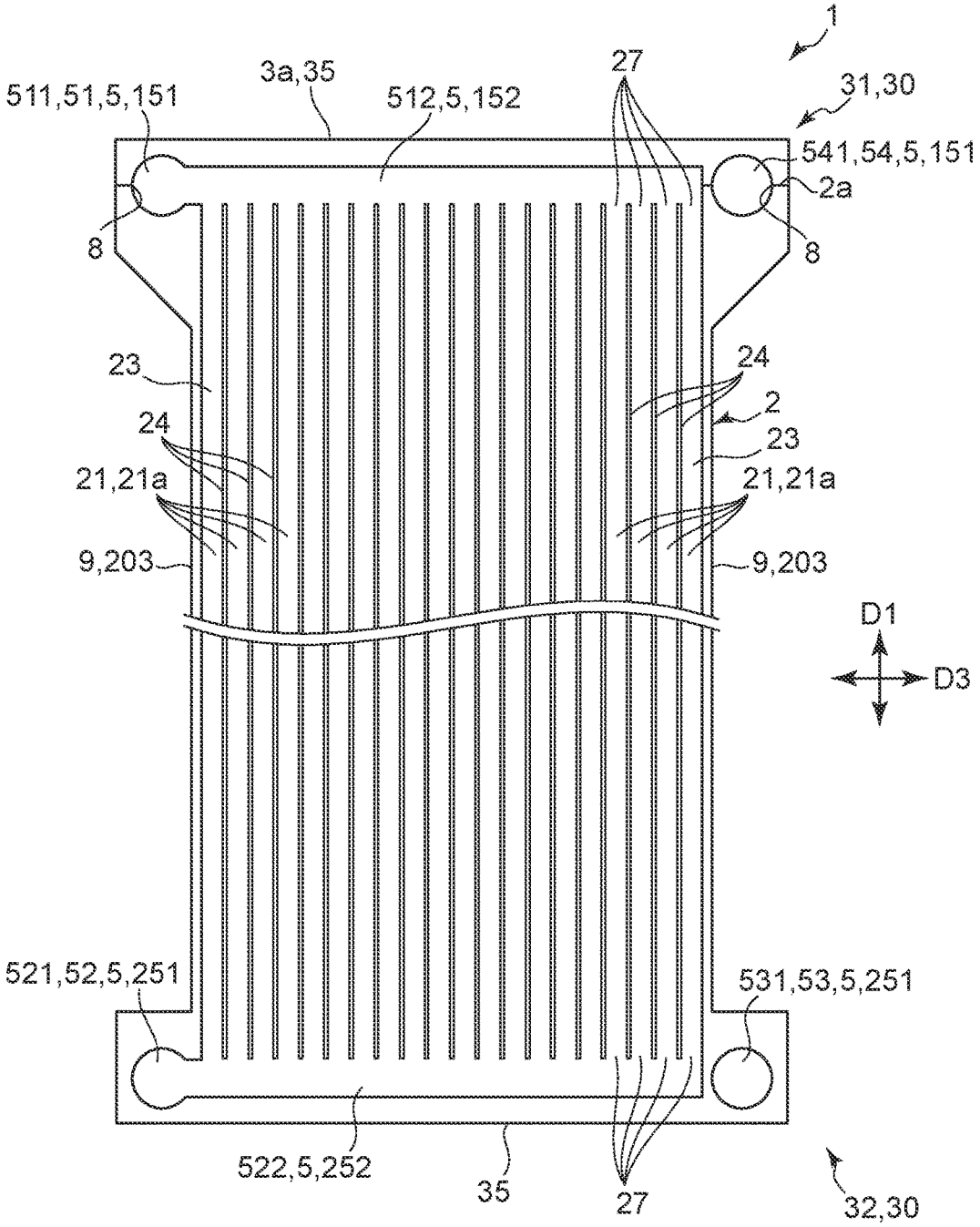
FIG. 5 is an end view of a section cut along the dotted line L2 of FIG. 1.

FIG. 5 is an end view of a section cut along the dotted line L2 of FIG. 1, which is cut inside the first channel 21.

Figure 6:
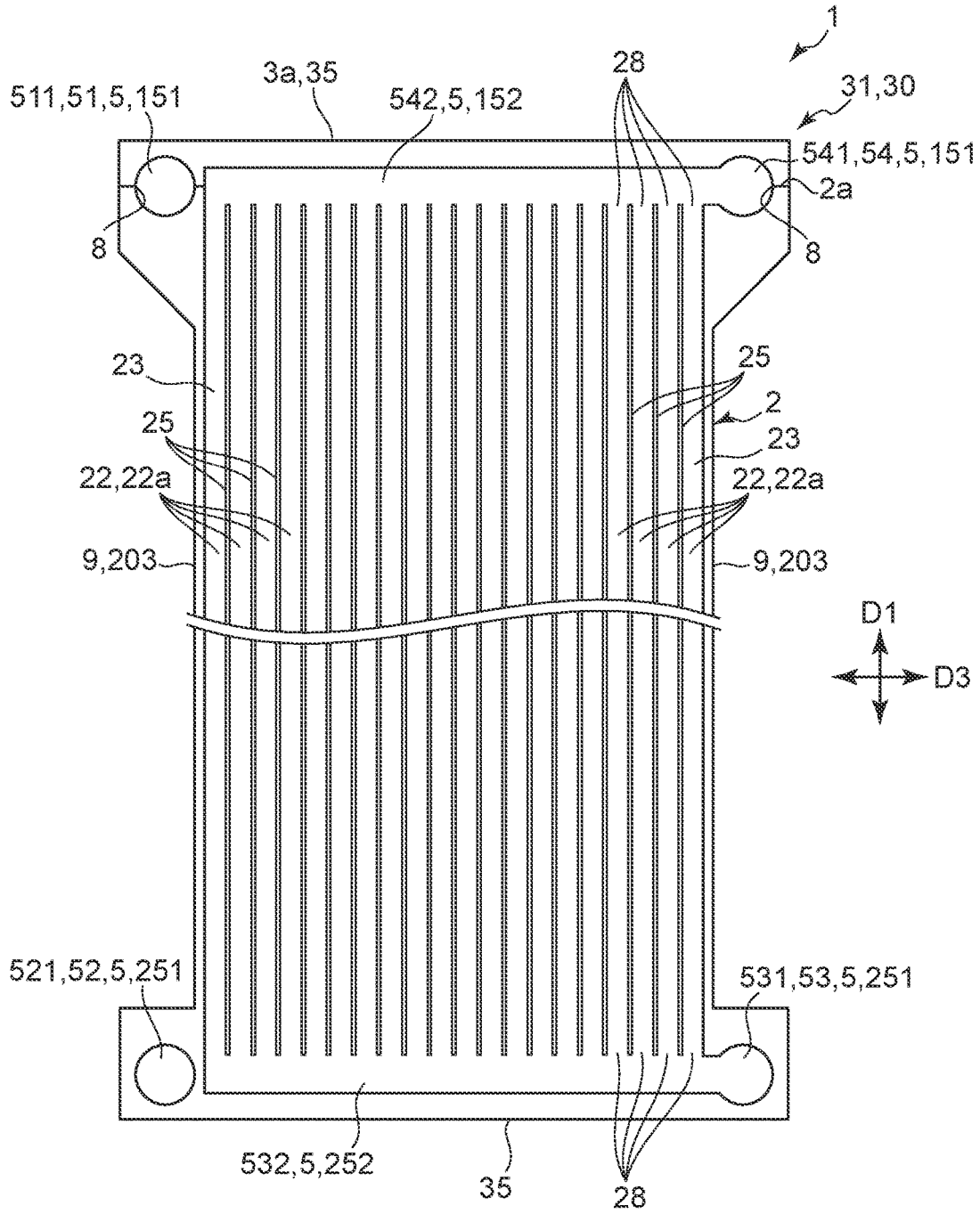
FIG. 6 is an end view of a section cut along the dotted line L3 of FIG. 1.

FIG. 6 is an end view of a section cut along the dotted line L3 of FIG. 1, which is cut inside the second channel 22.

Figure 7:
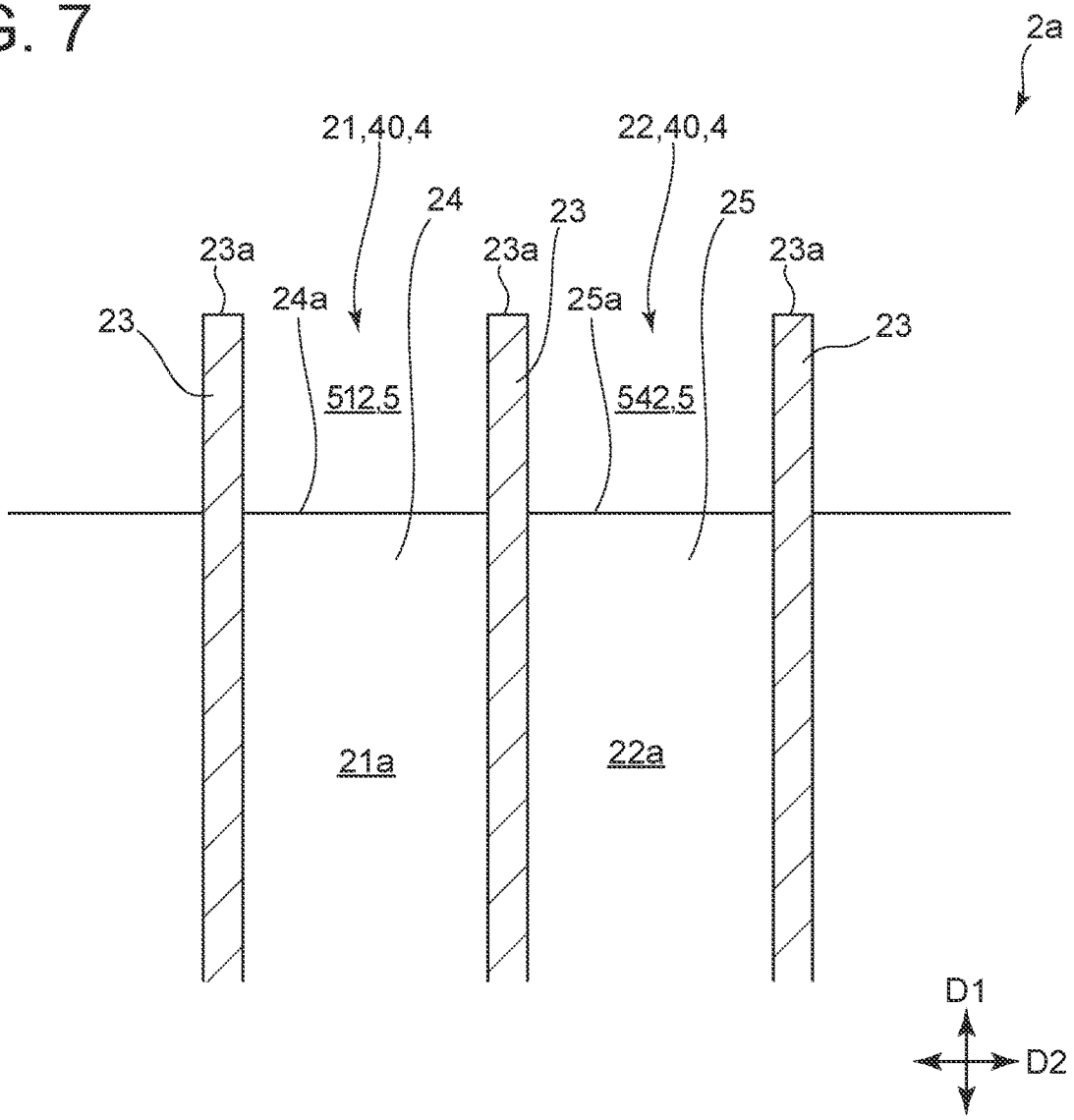
FIG. 7 is an enlarged cross-sectional view of a portion of the vicinity of an end surface at one end in the longitudinal direction of a body portion of a heat exchanger core according to some embodiments.

FIG. 7 is an enlarged cross-sectional view of a portion of the vicinity of an end surface 2*a* at one end in the longitudinal direction of the body portion of the heat exchanger core 1 according to some embodiments, as viewed from a third extension direction, which will be described later.

As shown in FIG. 4, a first opening 27 of each first channel 21 and a second opening 28 of each second channel 22 are formed on an end surface 2*a* at one end in the longitudinal direction of the core body 2. That is, when the lid member 3*a* (see FIG. 1) is not attached to the core body 2, the first opening 27 of each first channel 21 and the second opening 28 of each second channel 22 are exposed on the end surface 2*a*. When the lid member 3*a* is attached to the end surface 2*a* of the core body 2 so as to cover the first opening 27 and the second opening 28 (state in FIG. 1), the exposure of the first opening 27 and the second opening 28 is covered.

As shown in FIGS. 1, 5, and 6, the heat exchanger core 1 includes a first header passage 51 which is the header passage 5 for introducing the first fluid into each first channel 21 (see FIGS. 2 and 3), and a second header passage 52 which is the header passage 5 for collecting the first fluid after flowing through each first channel 21. The heat exchanger core 1 includes a third header passage 53 which is the header passage 5 for introducing the second fluid into each second channel 22 (see FIGS. 2 and 3), and a fourth header passage 54 which is the header passage 5 for collecting the second fluid after flowing through each second channel 22. As will be discussed in detail for describing the heat exchange operation in the heat exchanger core 1, the configuration of FIGS. 1, 5, and 6 is the case of counter-current flow of the first fluid flowing through each first channel 21 and the second fluid flowing through each second channel 22. In the case of parallel flow of the first fluid and the second fluid, the positions of the first header passage 51 and the second header passage 52 are switched, or the positions of the third header passage 53 and the fourth header passage 54 are switched.

The first header passage 51 includes a common passage 511 extending in a second extension direction D2 intersecting the first extension direction D1 inside the first header 31, and a plurality of branch passages 512 connecting the common passage 511 to the plurality of first channels 21.

Similarly, the second header passage 52 includes a common passage 521 extending in the second extension direction D2 inside the second header 32, and a plurality of branch passages 522 connecting the common passage 521 to the plurality of first channels 21.

The third header passage 53 includes a common passage 531 extending in the second extension direction D2 inside the second header 32, and a plurality of branch passages 532 connecting the common passage 531 to the plurality of second channels 22.

The fourth header passage 54 includes a common passage 541 extending in the second extension direction D2 inside the first header 31, and a plurality of branch passages 542 connecting the common passage 541 to the plurality of second channels 22.

That is, in some embodiments, the second extension direction D2 is a direction in which one of three mutually orthogonal axes of the core body 2 extends, i.e., the extension direction of the common passages 511, 521, 513, 541 of the header passages 5. The second extension direction D2 is also referred to as a second direction D2.

In some embodiments, a direction in which the axis other than the axis extending along the first extension direction D1 and the axis extending along the second extension direction D2 of the three mutually orthogonal axes of the core body 2 extends is referred to as a third extension direction D3 or a third direction D3.

In some embodiments, each branch passage 512, 522, 532, 542 extends along the third extension direction D3.

The common passage 511 of the first header passage 51 and the common passage 541 of the fourth header passage 54 in the first header 31 are also referred to as a first common passage 151. The branch passage 512 of the first header passage 51 and the branch passage 542 of the fourth header passage 54 in the first header 31 are also referred to as a first branch passage 152.

The common passage 521 of the second header passage 52 and the common passage 531 of the third header passage 53 in the second header are also referred to as a second common passage 251. The branch passage 522 of the second header passage 52 and the branch passage 532 of the third header passage 53 in the second header are also referred to as a second branch passage 252.

As shown in FIG. 7, the respective end portions 24*a*, 25*a* of the dividing walls 24, 25 are located on the other end side of the core body 2 in the longitudinal direction (on the lower side in FIG. 7) relative to the end portion 23*a* of the partition wall 23. Accordingly, in the vicinity of the end surface 2*a*, each first channel 21 and each second channel 22 are not divided into a plurality of divided channels 21*a* and divided channels 22*a* by the dividing walls 24, 25 to form the branch passage 512 and the branch passage 542 communicating with the divided channels 21*a* and the divided channels 22*a*, respectively.

As shown in FIG. 4, each branch passage 512 communicates with the common passage 511 of the first header passage 51, and each branch passage 542 communicates with the common passage 541 of the fourth header passage 54. Each branch passage 542 is sealed at the end adjacent to the first header passage 51 by a wall 23*b* connected to the two adjacent partition walls 23, 23 that defines the second channel 22, so that the branch passage 542 does not communicate with the common passage 511 of the first header passage 51. Each branch passage 512 is sealed at the end adjacent to the fourth header passage 54 by a wall 23*c* connected to the two adjacent partition walls 23, 23 that defines the first channel 21, so that the branch passage 512 does not communicate with the common passage 541 of the fourth header passage 54.

As well as the first header passage 51 communicates with the first channels 21, and the fourth header passage 54 communicates with the second channels 22, at the other end side of the core body 2 in the longitudinal direction, the second header passage 52 communicates with the first channels 21, and the third header passage 53 communicates with the second channels 22, but detailed description will be omitted.

In the case of the configuration shown in FIG. 4 at one end side of the core body 2 in the longitudinal direction, when attaching the lid member 3*a* to the end surface 2*a* of the core body 2, it is necessary to form a seal between the first channel 21 and the second channel 22. When the lid member 3*a* is detachably attached to the end surface 2*a* of the core body 2, the above-described seal can be formed by, for example, placing a seal member such as a rubber plate or a liquid gasket between the lid member 3*a* and the end surface 2*a*, and fastening the lid member 3*a* to the core body 2 with a bolt. When the lid member 3*a* is irreversibly attached to the end surface 2*a* of the core body 2, the above-described seal can be formed by, for example, with the lid member 3*a* placed on the end surface 2*a*, irradiating the lid member 3*a* with laser from the outer surface side along the end portions 23*a* (see FIG. 7) of the partition walls 23 and the end portions of the walls 23*b*, 23*c* to join the back surface of the lid member 3*a* to the end portions 23*a* of the partition walls 23 and the end portions of the walls 23*b*, 23*c*. In addition, the above-described seal may be formed by applying a brazing material to the joint position between the lid member 3*a* and the end surface 2*a* of the core body 2 with the lid member 3*a* placed on the end surface 2*a* for brazing in a furnace, or bonding the lid member 3*a* to the end surface 2*a* of the core body 2 with adhesive.

<Heat Exchange Operation of Heat Exchanger Core According to First Embodiment of Present Disclosure>

Next, the heat exchange operation for exchanging heat between the first fluid and the second fluid in the heat exchanger core 1 will be described. As shown in FIG. 1, the first fluid is supplied to the first header passage 51 and the second fluid is supplied to the third header passage 53. As shown in FIG. 4, at one end side in the longitudinal direction of the core body 2, the first fluid supplied to the common passage 511 of the first header passage 51 is introduced through the plurality of branch passages 512 into the divided channels 21*a* of each first channel 21. On the other hand, at the other end side in the longitudinal direction of the core body 2, the second fluid supplied to the common passage 531 of the third header passage 53 is introduced through the plurality of branch passages 532 into the divided channels 22*a* of each second channel 22. The first fluid flowing through the first channel 21 and the second fluid flowing through the second channel 22 exchange heat via the partition wall 23. When the heat exchanger core 1 has the configuration shown in FIG. 1, the flow directions of the first fluid and the second fluid are opposite in the longitudinal direction of the core body 2. However, the first fluid and the second fluid are not limited to flowing in countercurrent, but may flow in parallel.

When the first channel 21 and the second channel 22 are provided with the ribs 26, as the first fluid and the second fluid collide with the ribs 26 or flow so as to bypass the ribs 26, the flows of the first and second fluids are disrupted, so that the boundary layer which inhibits heat exchange is disrupted. This improves the heat exchange efficiency between the first fluid and the second fluid. Further, when the rib 26 is connected to both of the pair of partition walls 23, 23, it is possible to reduce the risk of deformation of the partition walls 23, i.e., the risk of narrowing of the flow path.

At one end side in the longitudinal direction of the core body 2, after the second fluid flows through the second channels 22 and exchanges heat with the first fluid, the second fluid having passed through each second channel 22 is introduced and collected into the common passage 541 of the fourth header passage 54 through the plurality of branch passages 542 and is discharged from the heat exchanger core 1. On the other hand, at the other end side in the longitudinal direction of the core body 2, after the first fluid flows through the first channels 21 and exchanges heat with the second fluid, the first fluid having passed through each first channel 21 is introduced and collected into the common passage 521 of the second header passage 52 through the plurality of branch passages 522 and is discharged from the heat exchanger core 1.

<Weight Reduction of Heat Exchanger Core>

The heat exchanger core 1 according to some embodiments is difficult to manufacture by laminating plates or casting due to the complexity of the structure. Therefore, it is preferable that the heat exchanger core 1 is produced by additive manufacturing using metal powder as a raw material. In this case, the heat exchanger core 1 is an additive manufactured body of metal powder. The metal powder used for additive manufacturing the heat exchanger core 1 is not particularly limited, but powder of stainless steel or titanium may be used. On the other hand, since the structure of the lid member 3*a* is not as complicated as the core body 2 and the header 30 of the heat exchanger core 1, the lid member 3*a* may be produced by casting or the like, or may be produced by additive manufacturing with metal powder in the same way as the core body 2 and the header 30. Further, it may be formed integrally with the core body 2 and the header 30 by additive manufacturing.

However, if the overall shape of the heat exchanger core 1 is a simple pillar shape, for example, there will be excess areas that do not contribute to the strength and heat exchange efficiency of the heat exchanger core 1, resulting in an increase in the weight of the heat exchanger core 1 and the manufacturing cost.

Then, in the heat exchanger core 1 according to some embodiments, the weight is reduced as follows, for instance.

Figure 8:
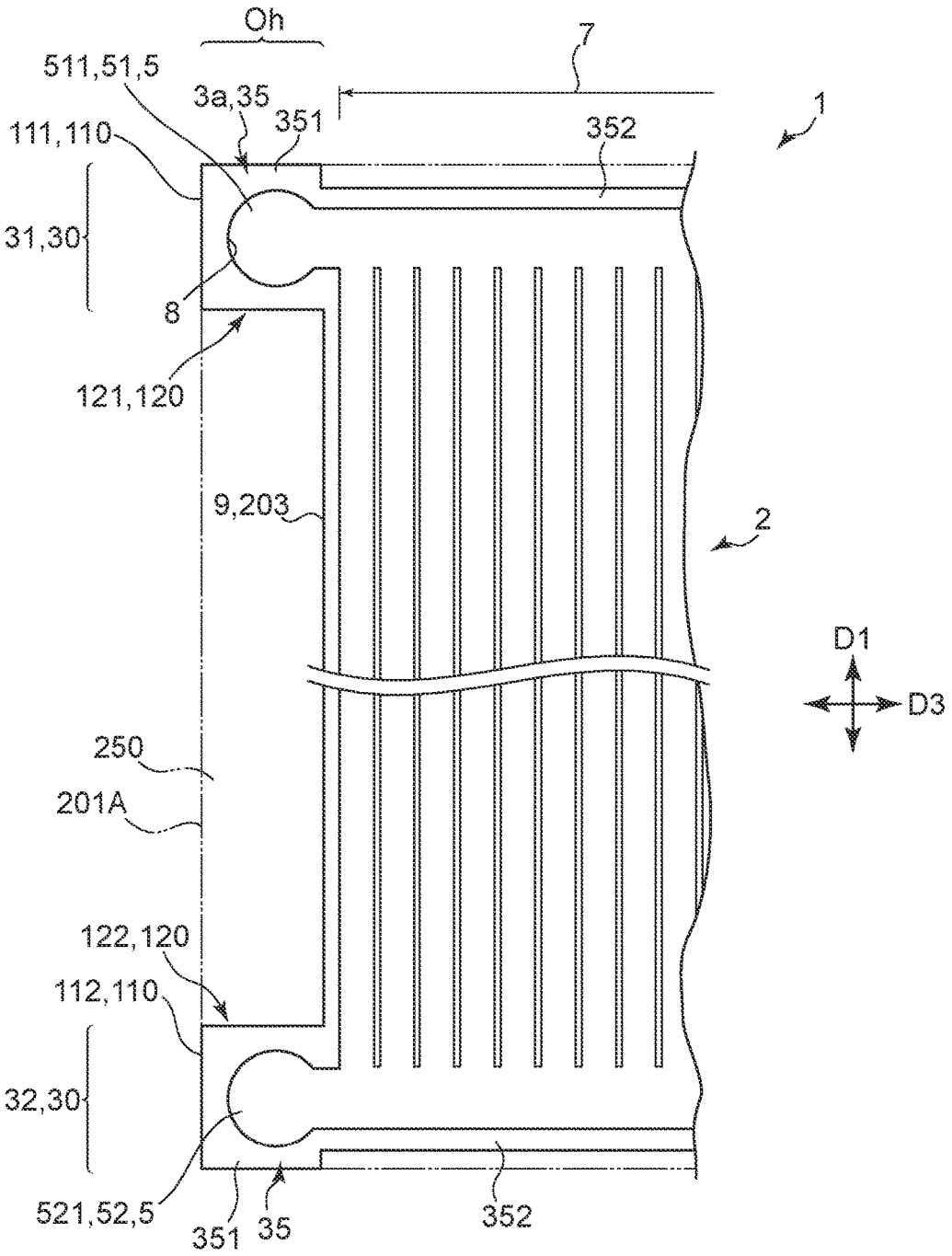
FIG. 8 is an enlarged view of a portion of a section of a heat exchanger core according to an embodiment among the embodiments, cut along the dotted line L2 of FIG. 1.

FIG. 8 is an enlarged view of a portion of a section of the heat exchanger core 1 according to an embodiment among the embodiments, cut along the dotted line L2 of FIG. 1.

Figure 9:
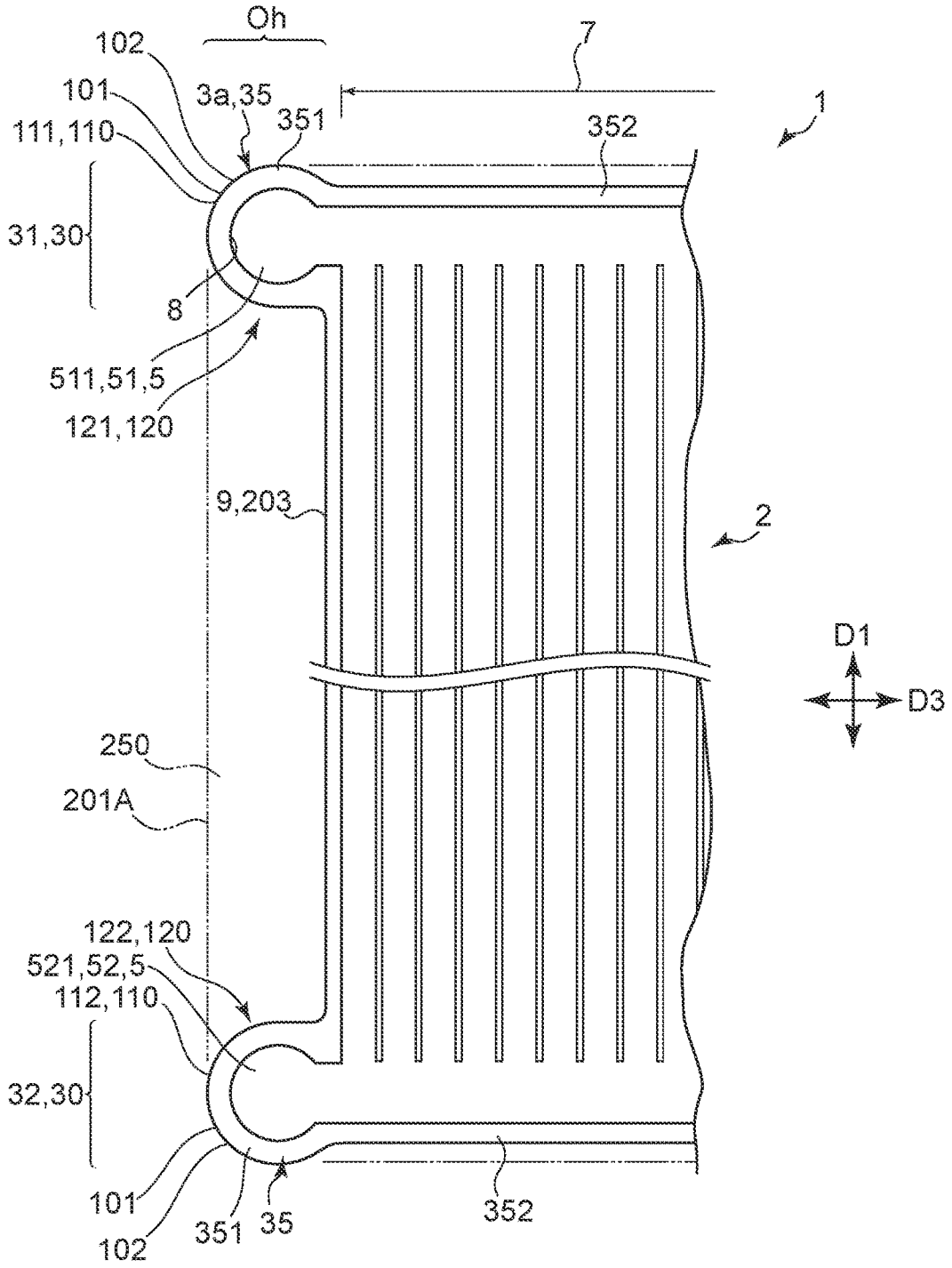
FIG. 9 is an enlarged view of a portion of a section of a heat exchanger core according to another embodiment among the embodiments, cut along the dotted line L2 of FIG. 1.

FIG. 9 is an enlarged view of a portion of a section of the heat exchanger core 1 according to another embodiment among the embodiments, cut along the dotted line L2 of FIG. 1.

Figure 10:
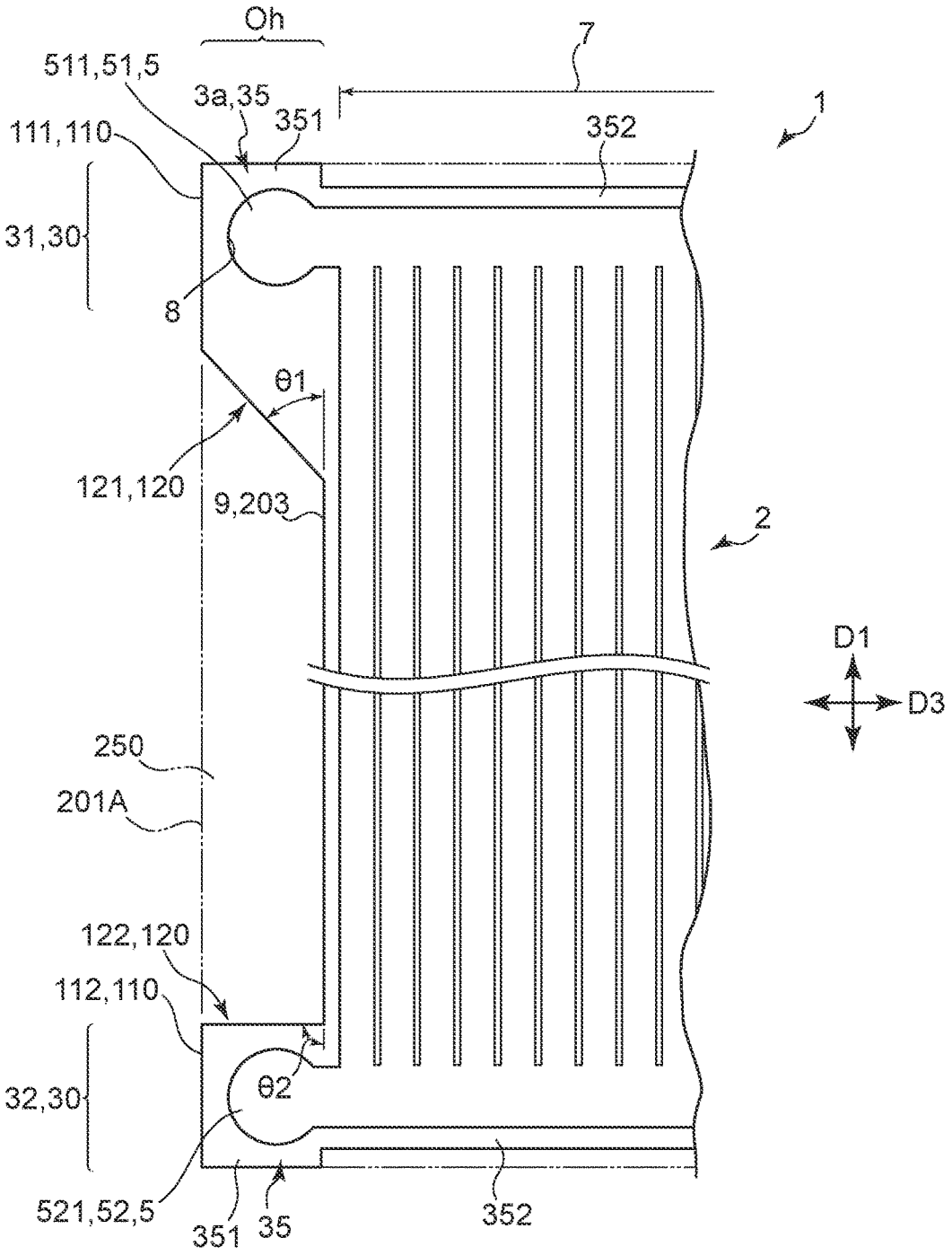
FIG. 10 is an enlarged view of a portion of a section of a heat exchanger core according to still another embodiment among the embodiments, cut along the dotted line L2 of FIG. 1.

FIG. 10 is an enlarged view of a portion of a section of the heat exchanger core 1 according to still another embodiment among the embodiments, cut along the dotted line L2 of FIG. 1.

In the heat exchanger core 1 according to some embodiments shown in FIGS. 8 to 10, the header passage 5 is at least partially located in a region displaced outward from an arrangement area 7 of the plurality of channels 4 in plan view as viewed from the first extension direction D1 of the plurality of channels 4. The core body 2 has a body side surface 9 extending along the first extension direction D1 at a position closer to the arrangement area 7 than a portion 8 (see FIGS. 8 to 10) of the header passage 5 that is farthest outward from the arrangement area 7 in the plan view.

In FIG. 4, for example, the arrangement area 7 according to some embodiments is a range surrounded by a rectangle of the dashed two-dotted line. Further, the portion 8 exists in a region surrounded by the dashed line in FIGS. 8 to 10.

In other words, in the heat exchanger core 1 according to some embodiments shown in FIGS. 8 to 10, two side surfaces 203 of the core body 2 spaced apart from each other along the third extension direction D3 are at least partially located further inward in the core body 2 along the third extension direction D3 than the portion 8.

For example, if the heat exchanger core 1 according to some embodiments shown in FIGS. 8 to 10 has a simple pillar shape, two virtual side surfaces 203A of the core body 2 spaced apart from each other along the third extension direction D3 have the shape indicated by the dashed two-dotted line in FIGS. 8 to 10. Then, there will be excess areas (excess region) that do not contribute to the strength and heat exchange efficiency of the heat exchanger core 1, resulting in an increase in the weight of the heat exchanger core 1 and the manufacturing cost. In FIGS. 8 to 10, the excess region 250 is, for example, a region between the side surface 203 drawn by the solid line and the virtual side surface 203A drawn by the dashed two-dotted line.

Thus, with the heat exchanger core 1 according to some embodiments, since the body side surface 9 is placed at a position closer to the arrangement area 7 than the portion 8 that is farthest outward from the arrangement area 7 in the plan view, the distance between the body side surface 9 and the arrangement area 7 can be reduced in the core body 2. As a result, the wall thickness of the portion between the body side surface 9 and the arrangement area 7 can be reduced, and the weight of the core body 2 can be reduced.

Further, since the wall thickness of the portion between the body side surface 9 and the arrangement area 7 can be reduced, the manufacturing cost and manufacturing time of the heat exchanger core can be reduced. When the heat exchanger core is formed by additive manufacturing, the effect of reducing the manufacturing cost and manufacturing time of the heat exchanger core is more remarkable.

In the heat exchanger core 1 according to some embodiments shown in FIGS. 8 to 10, the header passage 5 includes a common passage 511, 521, 531, 541 extending in the second extension direction D2 intersecting the first extension direction D1 inside the header 30, and a plurality of branch passages 512, 522, 532, 542 connecting the common passage 511, 521, 531, 541 to the plurality of channels 4. In the plan view, the body side surface 9 may extend along the second extension direction D2 to at least one of one end 5*a* or the other end 5*b* of the common passage 511, 521, 531, 541 inside the header 30. For example, in the heat exchanger core 1 according to some embodiments shown in FIG. 1, in the plan view, the body side surface 9 extends along the second extension direction D2 from one end 5*a* to the other end 5*b* of the common passage 511, 521, 531, 541 inside the header 30.

In the heat exchanger core 1 according to some embodiments, since the heat exchanger core 1 is configured such that the body side surface 9 extends along the second extension direction D2 to at least one of one end 5*a* or the other end 5*b* of the common passage 511, 521, 531, 541 inside the header 30, the range in which the distance between the body side surface 9 and the arrangement area 7 can be reduced can be further increased in the core body 2. Thus, the weight of the core body 2 can be further reduced, and the manufacturing cost and manufacturing time of the heat exchanger core 1 can be further reduced.

In the heat exchanger core 1 according to some embodiments, one end 5*a* of the common passage 511, 521, 513, 541 is an open end on one of two side surfaces 302 (see FIG. 1) of the header 30 spaced from each other along the second extension direction D2. In the heat exchanger core 1 according to some embodiments, the other end 5*b* of the common passage 511, 521, 513, 541 is a closed end on the other of two side surfaces 302 of the header 30 spaced from each other along the second extension direction D2.

In the heat exchanger core 1 according to some embodiments, in the plan view, the body side surface 9 may extend along the second extension direction D2 to at least one of the two side surfaces 302 (see FIG. 1).

In the heat exchanger core 1 according to some embodiments shown in FIGS. 8 to 10, the header 30 includes a header lid portion 35 disposed at an end portion of the heat exchanger core 1 along the first extension direction D1 to cover the header passage 5. In the heat exchanger core 1 according to some embodiments, it may be the lid member 3*a*.

In the heat exchanger core 1 according to some embodiments shown in FIGS. 8 to 10, the header lid portion 35 includes a first region 351 covering the common passage 511, 521, 531, 541 and a second region 352 covering the plurality of branch passages 512, 522, 532, 542. At least part of the second region 352 is recessed toward the core body 2 along the first extension direction D1 with respect to the first region 351.

Thus, the weight of the header lid portion 35 can be reduced as compared with the case where the second region 352 is not recessed toward the core body 2. Thus, the weight of the heat exchanger core 1 can be reduced, and the manufacturing cost and manufacturing time of the heat exchanger core 1 can be further reduced.

In the heat exchanger core 1 shown in FIG. 9, a portion of an outer surface 101 of the heat exchanger core 1 in at least part of the first region 351 and a region between the first region 351 and the body side surface 9 has a curved surface 102 protruding toward the outer side of the heat exchanger core 1.

Specifically, in the heat exchanger core 1 shown in FIG. 9, at least a portion of an outer peripheral portion 56*a* of a passage wall portion 56 which forms the common passage 511, 521 may have an arc shape with the center of curvature inside the common passage 511, 521, when viewed from the second extension direction D2, for example.

When the heat exchanger core 1 includes the curved surface 102, there is no thick portion constituting the heat exchanger core 1 in a region on the opposite side of the curved surface 102 from the region where the center of curvature of the curved surface 102 lies, so that the weight of the heat exchanger core 1 can be reduced, and the manufacturing cost and manufacturing time of the heat exchanger core 1 can be reduced.

The heat exchanger core 1 according to some embodiments shown in FIGS. 8 to 10 has a connection region 120 connecting an outer surface 110 of the header 30 to the body side surface 9. Specifically, the heat exchanger core 1 according to some embodiments shown in FIGS. 8 to 10 has a first connection region 121 connecting an outer surface 111 of the first header 31 to the body side surface 9, and a second connection region 122 connecting an outer surface 112 of the second header 32 to the body side surface 9.

In the heat exchanger core 1 shown in FIG. 10, the inclination angle θ1 of the extension direction of the first connection region 121 with respect to the first extension direction D1 is 25 degrees or more and 60 degrees or less.

As described above, in the heat exchanger core 1, the header passage 5 is at least partially located in a region displaced outward from the arrangement area 7 of the plurality of channels 4 in the plan view.

Therefore, for example, when the heat exchanger core 1 is formed by additive manufacturing by stacking layers from the second header 32 to the first header 31, the first header 31 has an overhang region Oh projecting outward from the body side surface 9 in a direction (third extension direction D3) perpendicular to the first extension direction D1.

In the heat exchanger core 1 shown in FIG. 10, the overhang region Oh of the first header 31 can be supported by the first connection region 121 from below. Thus, the first connection region 121 also serves as a support for the overhang region Oh during additive manufacturing, so that the step of removing the support can be eliminated.

Here, if the inclination angle θ1 is less than 25 degrees, the size of the first connection region 121 along the first extension direction D1 is large, which may cause an unnecessary weight increase of the heat exchanger core 1. Therefore, it is desirable that the inclination angle θ1 is 25 degrees or more.

Further, if the inclination angle θ1 is more than 60 degrees, the overhang angle of the first connection region 121 may be too large to form a desired shape. Therefore, it is desirable that the inclination angle θ1 is 60 degrees or less.

Therefore, according to the heat exchanger core 1 shown in FIG. 10, the above-described inclination angle θ1 is desirable.

In the heat exchanger core 1 shown in FIG. 10, the shape of the second connection region 122 may be the same as the shape of the first connection region 121. That is, in the heat exchanger core 1 shown in FIG. 10, the inclination angle θ2 of the extension direction of the second connection region 122 with respect to the first extension direction D1 may be 25 degrees or more and 60 degrees or less.

Preferably, in the heat exchanger core 1 shown in FIG. 10, the inclination angle θ2 of the extension direction of the second connection region 122 with respect to the first extension direction D1 is 85 degrees or more and 95 degrees or less.

For example, when the heat exchanger core 1 is formed by additive manufacturing by stacking layers from the second header 32 to the first header 31, the body side surface 9 of the core body 2 to be placed above the second header 32 is recessed inward with respect to the second header 32 along the third extension direction D3 perpendicular to the first extension direction D1. Therefore, the overhang region Oh is not formed when the core body 2 is formed above the second header 32.

In this context, for example, since the size of the second connection region 122 along the first extension direction D1 increases as the inclination angle θ2 of the second connection region 122 decreases less than 90 degrees, the inclination angle θ2 of 85 degrees or less may cause an unnecessary weight increase of the heat exchanger core 1. Therefore, it is desirable that the inclination angle θ2 is 85 degrees or more.

Further, for example, if the inclination angle θ2 is more than 95 degrees, the shape change at the connection between the second connection region 122 and the body side surface 9 is large, which may cause stress concentration. Therefore, it is desirable that the inclination angle θ2 is 95 degrees or less.

Therefore, according to the heat exchanger core 1 shown in FIG. 10, the above-described inclination angle θ2 is desirable.

Figure 11:
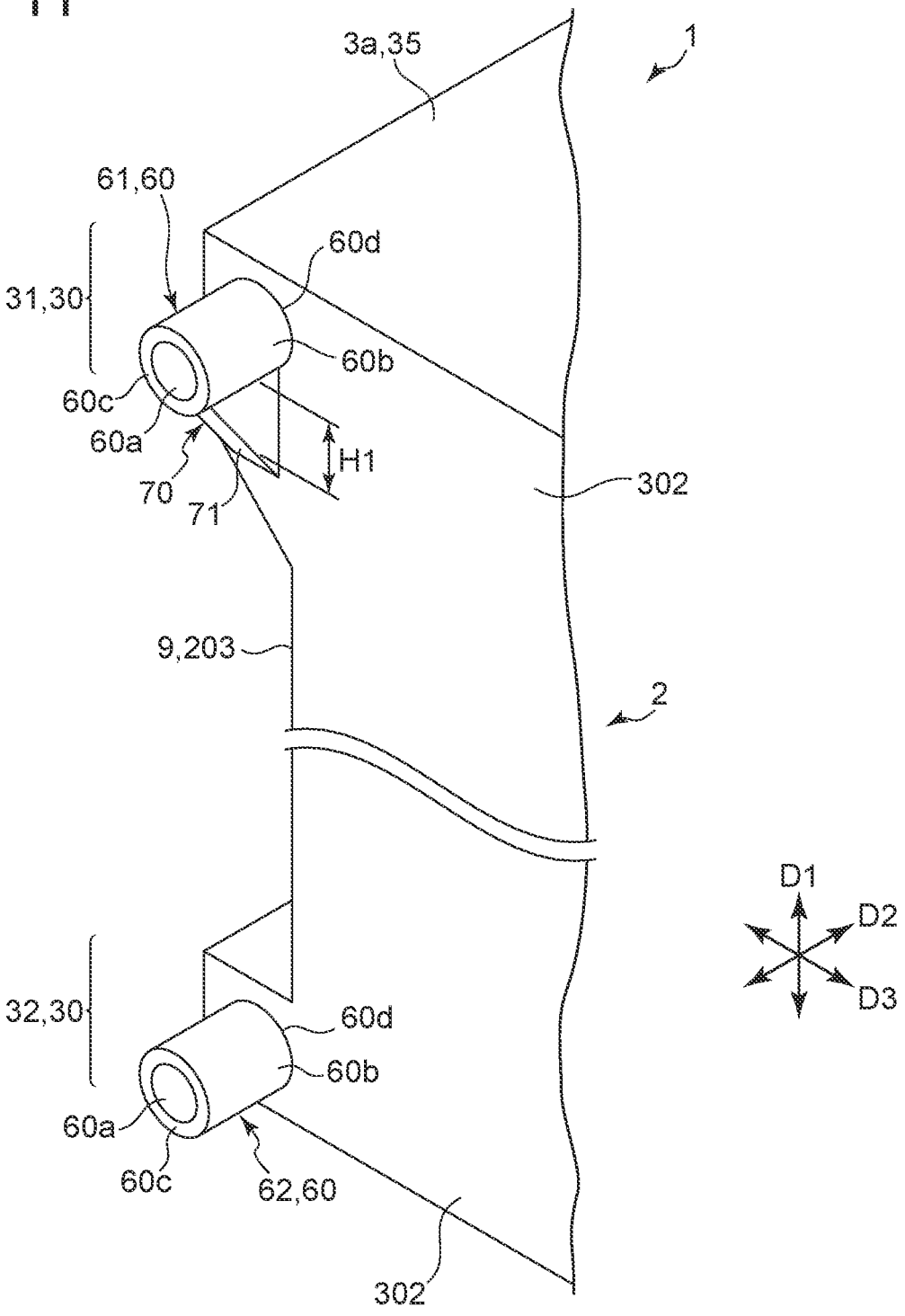
FIG. 11 is a perspective view of a portion of a heat exchanger core according to still another embodiment among the embodiments.

FIG. 11 is a perspective view of a portion of the heat exchanger core 1 according to still another embodiment among the embodiments. In the heat exchanger core 1 shown in FIG. 11, the header 30 may include a projecting tube 60 having a passage 60*a* that communicates with the common passage 511, 521, 531, 541 and projecting from the header 30 along the second extension direction D2. The heat exchanger core 1 may further include a support portion 70 connecting a side portion 60*b* of the projecting tube 60 to the core body 2 to support the side portion 60*b* along the first extension direction D1 from the core body 2. The support portion 70 may be formed so as to have an inclined surface 71 such that a distance H1 from the side portion 60*b* along the first extension direction D1 increases from a distal end 60*c* side to a proximal end 60*d* side of the projecting tube 60.

Specifically, the heat exchanger core 1 shown in FIG. 11 may include a first projecting tube 61 having a passage 60*a* that communicates with the first common passage 151 and projecting from the first header 31 along the second extension direction D2 in the first header 31, and a second projecting tube 62 having a passage 60*a* that communicates with the second common passage 251 and projecting from the second header 32 along the second extension direction D2 in the second header 32.

The support portion 70 may be provided on the first projecting tube 61 and the second projecting tube 62, or may be provided only on one of the first projecting tube 61 or the second projecting tube 62.

For example, when the heat exchanger core 1 is formed by additive manufacturing by stacking layers along the first extension direction D1, the first projecting tube 61 and the second projecting tube 62 become overhang regions projecting from the first header 31 and the second header 32 along the second extension direction D2.

Therefore, if the support portion 70 is provided on at least one of the first projecting tube 61 or the second projecting tube 62, at least one of the first projecting tube 61 or the second projecting tube 62, which becomes the overhang region, can be supported by the support portion 70 from below.

For example, in the case where the support portion 70 is provided only on the first projecting tube 61, for example, when the heat exchanger core 1 is formed by additive manufacturing by stacking layers from the second header 32 to the first header 31, the second projecting tube 62 is placed in a lower region of the heat exchanger core 1 in additive manufacturing. Therefore, even if the support portion 70 is not provided for the second projecting tube 62, the support for forming the second projecting tube 62 is unnecessary, or even if necessary, the length of the support in the stacking direction can be short since the distance from the build table of the additive manufacturing apparatus is short. As a result, the time required for forming the support can be reduced, and the time required for the support removal step can also be reduced.

Similarly, for example, in the case where the support portion 70 is provided only on the second projecting tube 62, for example, when the heat exchanger core 1 is formed by additive manufacturing by stacking layers from the first header 31 to the second header 32, the first projecting tube 61 is placed in a lower region of the heat exchanger core 1 in additive manufacturing. Therefore, even if the support portion 70 is not provided for the first projecting tube 61, the support for forming the first projecting tube 61 is unnecessary, or even if necessary, the length of the support in the stacking direction can be short since the distance from the build table of the additive manufacturing apparatus is short. As a result, the time required for forming the support can be reduced, and the time required for the support removal step can also be reduced.

<Heat Exchanger>

Figure 12:
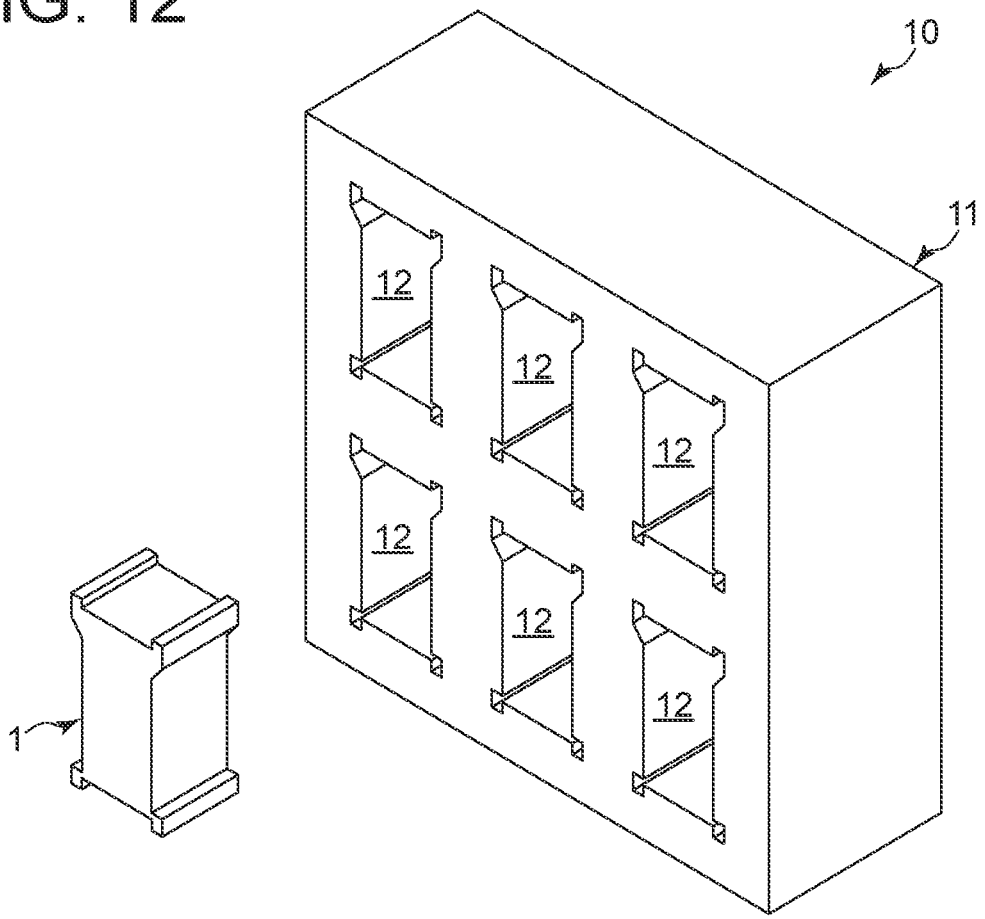
FIG. 12 is a schematic exploded view of a configuration of a heat exchanger according to an embodiment.

FIG. 12 is a schematic exploded view of a configuration of a heat exchanger 10 according to an embodiment. The heat exchanger 10 according to an embodiment is equipped with at least one heat exchanger core 1 according to the above-described embodiments, and a housing 11 to which the at least one heat exchanger core 1 is attached.

The housing 11 has an insertion space 12 into which the heat exchanger core 1 is inserted. In FIG. 12, the number of insertion spaces 12 is six, but only one insertion space 12 may be formed, or any multiple number of insertion spaces 12 may be formed, without limiting the number to six. When multiple insertion spaces 12 are formed in the housing 11, the layout of the insertion spaces 12 can be freely designed.

Thereby, the heat exchanger 10 including at least one heat exchanger core 1 can be provided. If the heat exchanger 10 includes two or more heat exchanger cores 1, the capacity of the heat exchanger 10 can be increased by the number of heat exchanger cores 1.

Figure 13:
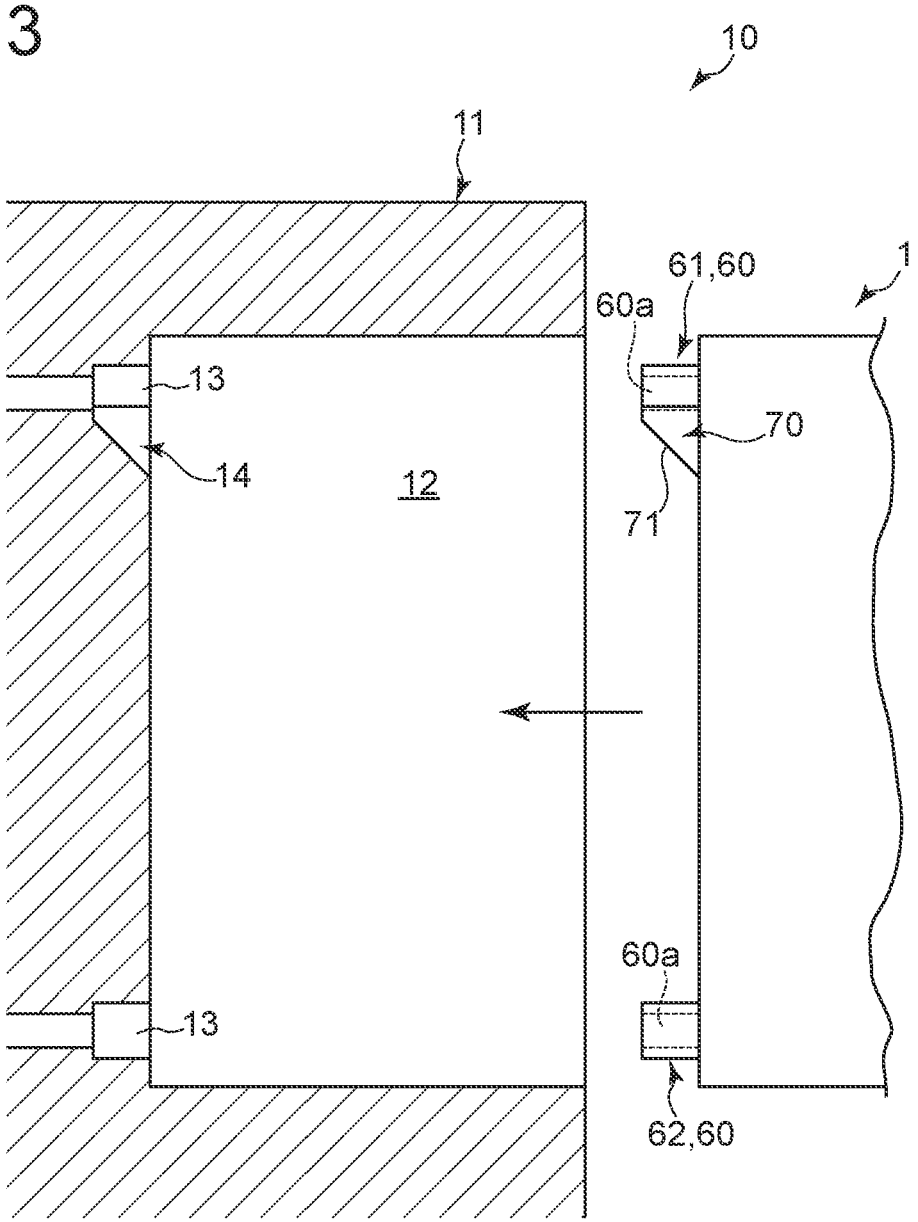
FIG. 13 is a schematic cross-sectional view of a structure of a heat exchanger according to another embodiment.

FIG. 13 is a schematic cross-sectional view of a structure of the heat exchanger 10 according to another embodiment.

The heat exchanger 10 shown in FIG. 13 is equipped with at least one heat exchanger core 1 shown in FIG. 11, and a housing 11 to which the at least one heat exchanger core 1 is attached. The housing 11 has a fitting recess 14 into which the support portion 70 is fitted when the heat exchanger core 1 shown in FIG. 11 is attached.

In the heat exchanger 10 shown in FIG. 13, the housing 11 has a recess 13 into which the projecting tube 60 is fitted when the heat exchanger core 1 shown in FIG. 11 is attached.

Thereby, the heat exchanger 10 including at least one heat exchanger core 1 shown in FIG. 11 can be provided. If the heat exchanger 10 includes two or more heat exchanger cores 1, the capacity of the heat exchanger 10 can be increased by the number of heat exchanger cores 1.

Further, in the heat exchanger 10 shown in FIG. 13, by fitting the support portion 70 of the heat exchanger core 1 into the fitting recess 14 of the housing 11, it is easy to finely adjust the attachment position of the heat exchanger core 1 to the housing 11.

Further, in the heat exchanger 10 shown in FIG. 13, the support portion 70 of the heat exchanger core 1 cannot be fitted into the fitting recess 14 of the housing 11 if the heat exchanger core 1 is attached to the housing 11 in the wrong orientation, etc., for example, if the posture of the heat exchanger core 1 is inverted upside down in FIG. 13. Thus, it is possible to reduce the possibility that the heat exchanger core 1 is attached to the housing 11 in the wrong attachment orientation, etc.

<Maintenance Method for Heat Exchanger>

Figure 14:
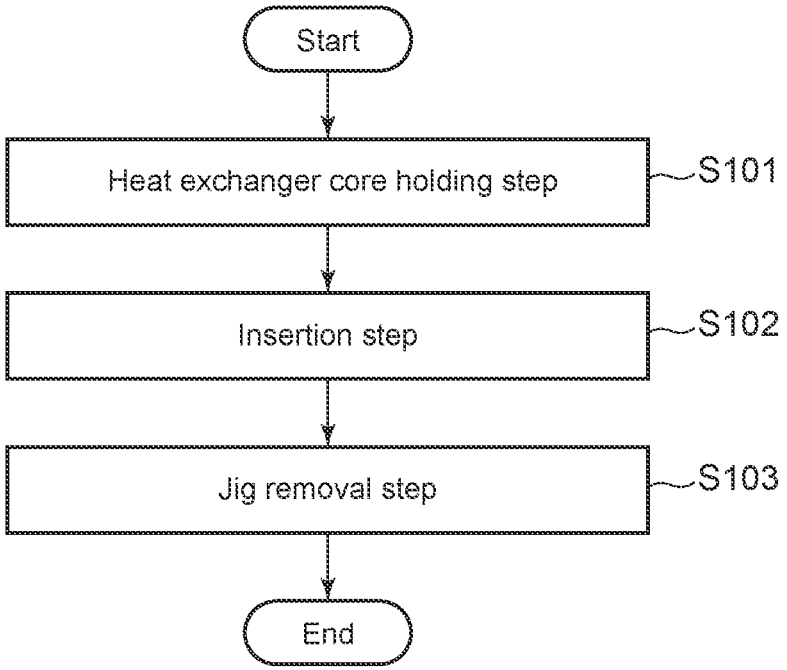
FIG. 14 is a flowchart showing the procedure of a maintenance method for a heat exchanger according to an embodiment.

FIG. 14 is a flowchart showing the procedure of a maintenance method for a heat exchanger according to an embodiment.

Figure 15:
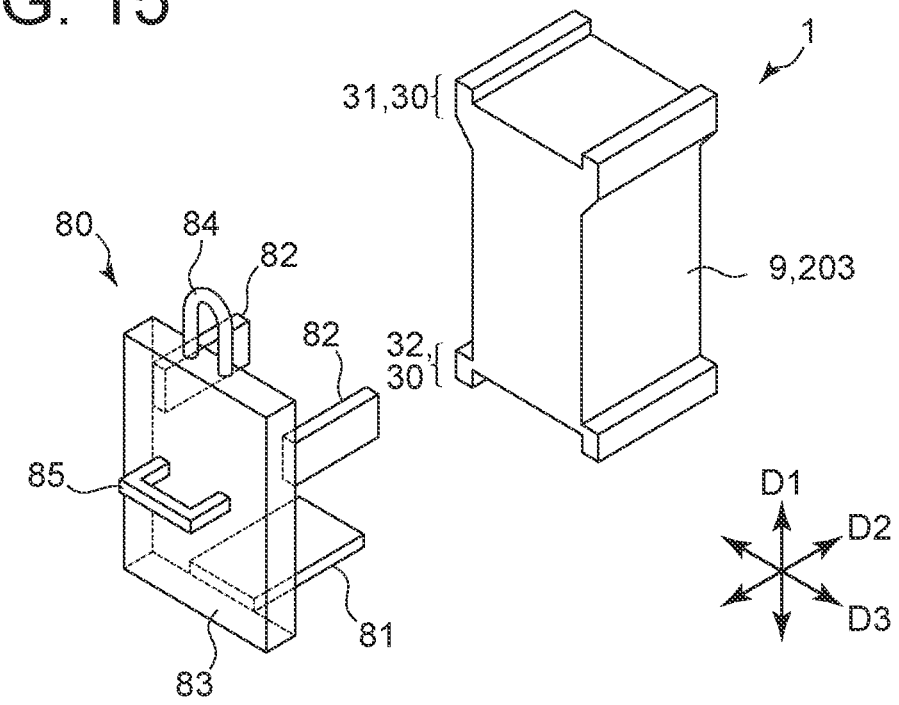
FIG. 15 is a schematic perspective view of a jig used in the maintenance method according to an embodiment.

FIG. 15 is a schematic perspective view of a jig 80 used in the maintenance method according to an embodiment.

The maintenance method according to an embodiment includes a heat exchanger core holding step S101 of holding the heat exchanger core 1 by a jig 80, an insertion step S102 of inserting the heat exchanger core 1 held by the jig 80 into a mounting portion (insertion space 12) for the heat exchanger core 1 in the housing 11 together with the jig 80, and a jig removal step S103 of removing the jig 80 from the insertion space 12 while the heat exchanger core 1 inserted in the insertion space 12 is left in the insertion space 12.

The heat exchanger core holding step S101 includes holding the heat exchanger core 1 while supporting the body side surface 9 from the side by the jig 80.

That is, in the maintenance method according to an embodiment, the jig 80 shown in FIG. 15 is used for attaching or detaching the heat exchanger core 1 to or from the housing 11.

The jig 80 shown in FIG. 15 includes a first arm portion 81 capable of supporting the heat exchanger core 1 in a posture in which the first header 31 faces upward and the second header 32 faces downward from below the second header 32, a pair of second arm portions 82 capable of supporting the pair of body side surfaces 9 from the side, and a body portion 83 on which the first arm portion 81 and the second arm portions 82 are mounted.

Further, the jig 80 shown in FIG. 15 includes, on the upper portion of the body portion 83, a hanger portion 84 to which a hook of a lifting device or the like can be attached. The jig 80 shown in FIG. 15 is provided with a handle portion 85 on the surface of the body portion 83 opposite to the surface on which the first arm portion 81 and the second arm portions 82 are mounted.

In the heat exchanger core holding step S101, the operator may attach the first arm portion 81 and the second arm portions 82 of the jig 80 shown in FIG. 15 to the heat exchanger core 1 from the second extension direction D2 to support the heat exchanger core 1 from below the second header 32 by the first arm portion 81, and support the pair of body side surfaces 9 from the side by the pair of second arm portions 82.

In the heat exchanger core holding step S101, with a hook of a lifting device (not shown) being attached to the hanger portion 84, the jig 80 may be moved vertically by the lifting device (not shown) to move the heat exchanger core 1 vertically along the first extension direction D1 while supporting the heat exchanger core 1 by the first arm portion 81 and the second arm portions 82.

In the heat exchanger core holding step S101, for example, while lifting the heat exchanger core 1 by the lifting device (not shown) using the jig 80, the operator may push and pull the heat exchanger core 1 with the handle portion 85 to move the heat exchanger core 1 along the second extension direction D2 or the third extension direction D3.

In the insertion step S102, the operator may insert the heat exchanger core 1 held by the jig 80 into the insertion space 12 of the housing 11 together with the jig 80 as described above.

After inserting the heat exchanger core 1 into the insertion space 12 of the housing 11 in the insertion step S102, in the jig removal step S103, the operator may remove the jig 80 from the insertion space 12 while the heat exchanger core 1 inserted in the insertion space 12 is left in the insertion space 12.

In the case of removing the heat exchanger core 1 inserted in the insertion space 12 from the insertion space 12, the heat exchanger core 1 can be removed from the insertion space 12 in the reverse procedure to that described above.

With the above-described maintenance method, the heat exchanger core 1 held by the jig 80 can be inserted into the insertion space 12 of the housing 11 together with the jig 80, so that the heat exchanger core 1 can be easily inserted into the insertion space 12. Further, with the above-described maintenance method, the jig 80 can be removed from the insertion space 12 while the heat exchanger core 1 inserted in the insertion space 12 is left in the insertion space 12, so that the jig 80 can be easily removed.

<Producing Method for Heat Exchanger Core>

Hereinafter, an example of the method of producing the above-described heat exchanger core 1 according to some embodiments will be described.

Figure 16:
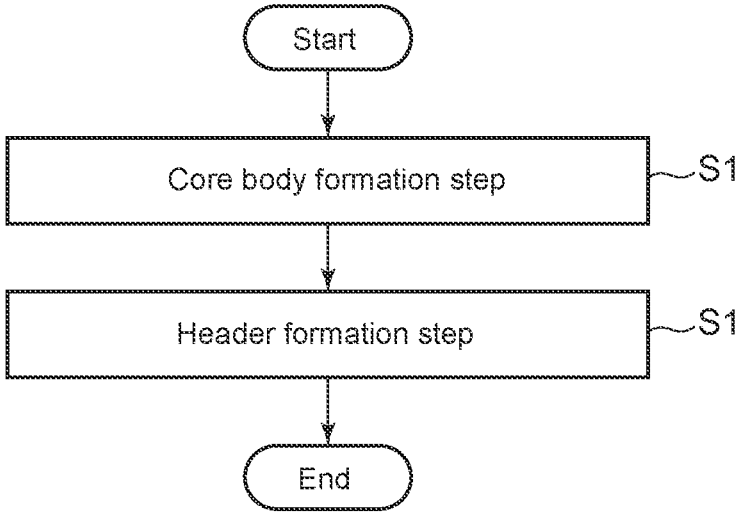
FIG. 16 is a flowchart showing the procedure of a producing method for a heat exchanger core according to some embodiments.

FIG. 16 is a flowchart showing the procedure of the method of producing the heat exchanger core 1 according to some embodiments.

The method of producing the heat exchanger core 1 according to some embodiments includes a core body formation step S1 of forming a core body 2 having a plurality of cavity portions 40 forming a plurality of channels 4 inside the core body 2 by additive manufacturing, and a header formation step S2 of forming a header 30 including a header passage 5 communicating with the plurality of channels 4 on at least one end side of the core body 2 by additive manufacturing.

The header formation step S2 includes forming the header passage 5 so as to be at least partially located in a region displaced outward from an arrangement area 7 of the plurality of channels 4 in plan view as viewed from the first extension direction D1 of the plurality of channels 4.

The core body formation step S1 includes forming the core body 2 so as to have a body side surface 9 extending along the first extension direction D1 at a position closer to the arrangement area 7 than a portion of the header passage 5 that is farthest outward from the arrangement area 7 in the plan view.

Thus, the core body 2 and the header 30 can be formed integrally by additive manufacturing.

The present disclosure is not limited to the embodiments described above, but includes modifications to the embodiments described above, and embodiments composed of combinations of those embodiments.

The contents described in the above embodiments would be understood as follows, for instance.

(1) A heat exchanger core 1 according to at least one embodiment of the present disclosure includes: a core body 2 having a plurality of cavity portions 40 forming a plurality of channels 4 inside the core body 2; and a header 30 including a header passage 5 communicating with the plurality of channels 4 on at least one end side of the core body 2. The header passage 5 is at least partially located in a region displaced outward from an arrangement area 7 of the plurality of channels 4 in plan view as viewed from a first extension direction D1 of the plurality of channels 4. The core body 2 has a body side surface 9 extending along the first extension direction D1 at a position closer to the arrangement area 7 than a portion of the header passage 5 that is farthest outward from the arrangement area 7 in the plan view.

With the above configuration (1), since the body side surface 9 is placed at a position closer to the arrangement area 7 than the portion 8 that is farthest outward from the arrangement area 7 in the plan view, the distance between the body side surface 9 and the arrangement area 7 can be reduced in the core body 2. As a result, the wall thickness of the portion between the body side surface 9 and the arrangement area 7 can be reduced, and the weight of the core body 2 can be reduced.

Further, since the wall thickness of the portion between the body side surface 9 and the arrangement area 7 can be reduced, the manufacturing cost and manufacturing time of the heat exchanger core can be reduced. When the heat exchanger core is formed by additive manufacturing, the effect of reducing the manufacturing cost and manufacturing time of the heat exchanger core is more remarkable.

(2) In some embodiments, in the above configuration (1), the header passage 5 includes a common passage 511, 521, 531, 541 extending in a second extension direction D2 intersecting the first extension direction D1 inside the header 30, and a plurality of branch passages 512, 522, 532, 542 connecting the common passage 511, 521, 531, 541 to the plurality of channels 4. In the plan view, the body side surface 9 extends along the second extension direction D2 to at least one of one end or another end of the common passage 511, 521, 531, 541 inside the header 30.

With the above configuration (2), since the heat exchanger core 1 is configured such that the body side surface 9 extends along the second extension direction D2 to at least one of one end 5*a* or the other end 5*b* of the common passage 511, 521, 531, 541 inside the header 30, the range in which the distance between the body side surface 9 and the arrangement area 7 can be reduced can be further increased in the core body 2. Thus, the weight of the core body 2 can be further reduced, and the manufacturing cost and manufacturing time of the heat exchanger core 1 can be further reduced.

(3) In some embodiments, in the above configuration (1) or (2), the header 30 includes a header lid portion 35 disposed at an end portion of the heat exchanger core 1 along the first extension direction D1 to cover the header passage 5. The header lid portion 35 includes a first region 351 covering the common passage 511, 521, 531, 541 and a second region 352 covering the plurality of branch passages 512, 522, 532, 542. At least part of the second region 352 is recessed toward the core body 2 along the first extension direction D1 with respect to the first region 351.

With the above configuration (3), the weight of the header lid portion 35 can be reduced as compared with the case where the second region 352 is not recessed toward the core body 2. Thus, the weight of the heat exchanger core 1 can be reduced, and the manufacturing cost and manufacturing time of the heat exchanger core 1 can be further reduced.

(4) In some embodiments, in any one of the above configurations (1) to (3), the header 30 includes a header lid portion 35 disposed at an end portion of the heat exchanger core 1 along the first extension direction D1 to cover the header passage 5. The header lid portion 35 includes a first region 351 covering the common passage 511, 521, 531, 541. A portion of an outer surface 101 of the heat exchanger core 1 in at least part of the first region 351 and a region between the first region 351 and the body side surface 9 has a curved surface 102 protruding toward the outer side of the heat exchanger core 1.

With the above configuration (4), since the heat exchanger core 1 includes the curved surface 102, there is no thick portion constituting the heat exchanger core 1 in a region on the opposite side of the curved surface 102 from the region where the center of curvature of the curved surface 102 lies, so that the weight of the heat exchanger core 1 can be reduced, and the manufacturing cost and manufacturing time of the heat exchanger core 1 can be reduced.

(5) In some embodiments, in any one of the above configurations (1) to (4), the heat exchanger core 1 further includes a connection region 120 connecting an outer surface 110 of the header 30 to the body side surface 9. The inclination angle of the extension direction of the connection region 120 with respect to the first extension direction D1 is 25 degrees or more and 60 degrees or less.

As described above, in the heat exchanger core 1, the header passage 5 is at least partially located in a region displaced outward from the arrangement area 7 of the plurality of channels 4 in the plan view.

Therefore, for example, when the heat exchanger core 1 is formed by additive manufacturing by stacking layers from the core body 2 to the header 30, the header 30 has an overhang region Oh projecting outward from the body side surface 9 in a direction perpendicular to the first extension direction D1.

With the above configuration (5), the overhang region Oh of the header 30 can be supported by the connection region 120 from below. Thus, the connection region 120 also serves as a support for the overhang region Oh during additive manufacturing, so that the step of removing the support can be eliminated.

Here, if the inclination angle is less than 25 degrees, the size of the connection region 120 along the first extension direction D1 is large, which may cause an unnecessary weight increase of the heat exchanger core 1. Therefore, it is desirable that the inclination angle is 25 degrees or more.

Further, if the inclination angle is more than 60 degrees, the overhang angle of the connection region 120 may be too large to form a desired shape. Therefore, it is desirable that the inclination angle is 60 degrees or less.

Therefore, according to the configuration (5), the above-described inclination angle is desirable.

(6) In some embodiments, in any one of the above configurations (1) to (4), the header 30 includes a first header 31 including a header passage 5 that communicates with the plurality of channels 4 on one end side of the core body 2, and a second header 32 including a header passage 5 that communicates with the plurality of channels 4 on another end side of the core body 2. The heat exchanger core 1 further includes a first connection region 121 connecting an outer surface 111 of the first header 31 to the body side surface 9, and a second connection region 122 connecting an outer surface 112 of the second header 32 to the body side surface 9. The inclination angle θ1 of the extension direction of the first connection region 121 with respect to the first extension direction D1 is 25 degrees or more and 60 degrees or less, and the inclination angle θ2 of the extension direction of the second connection region 122 with respect to the first extension direction D1 is 85 degrees or more and 95 degrees or less.

As described above, in the heat exchanger core 1, the header passage 5 is at least partially located in a region displaced outward from the arrangement area of the plurality of channels 4 in the plan view.

Therefore, for example, when the heat exchanger core 1 is formed by additive manufacturing by stacking layers from the second header 32 to the first header 31, the first header 31 has an overhang region Oh projecting outward from the body side surface 9 in a direction perpendicular to the first extension direction D1.

With the above configuration (6), the overhang region Oh of the first header 31 can be supported by the first connection region 121 from below. Thus, the first connection region 121 also serves as a support for the overhang region Oh during additive manufacturing, so that the step of removing the support can be eliminated.

Here, if the inclination angle θ1 of the first connection region 121 is less than 25 degrees, the size of the first connection region 121 along the first extension direction D1 is large, which may cause an unnecessary weight increase of the heat exchanger core 1. Therefore, it is desirable that the inclination angle θ1 is 25 degrees or more.

Further, if the inclination angle θ1 is more than 60 degrees, the overhang angle of the first connection region 121 may be too large to form a desired shape. Therefore, it is desirable that the inclination angle θ1 is 60 degrees or less.

Therefore, according to the above configuration, the above-described inclination angle is desirable.

On the other hand, the body side surface 9 of the core body 2 to be placed above the second header 32 is recessed inward with respect to the second header 32 along a direction perpendicular to the first extension direction D1. Therefore, the overhang region is not formed when the core body 2 is formed above the second header 32.

In this context, for example, the inclination angle θ2 of the second connection region 122 of 85 degrees or less may cause an unnecessary weight increase of the heat exchanger core 1. Therefore, it is desirable that the inclination angle θ2 is 85 degrees or more.

Further, for example, if the inclination angle θ2 is more than 95 degrees, the shape change at the connection between the second connection region 122 and the body side surface 9 is large, which may cause stress concentration. Therefore, it is desirable that the inclination angle θ2 is 95 degrees or less.

Therefore, according to the above configuration, the above-described inclination angle θ2 is desirable.

(7) In some embodiments, in any one of the above configurations (1) to (6), the header passage 5 includes a common passage 511, 521, 531, 541 extending in a second extension direction D2 intersecting the first extension direction D1 inside the header 30, and a plurality of branch passages 512, 522, 532, 542 connecting the common passage 511, 521, 531, 541 to the plurality of channels 4. The header 30 includes a projecting tube 60 having a passage 60*a* that communicates with the common passage 511, 521, 531, 541 and projecting from the header 30 along the second extension direction D2. The heat exchanger core 1 further includes a support portion 70 connecting a side portion 60*b* of the projecting tube 60 to the core body 2 to support the side portion 60*b* along the first extension direction D1 from the core body 2. The support portion 70 is formed so as to have an inclined surface 71 such that a distance H1 from the side portion 60*b* along the first extension direction D1 increases from a distal end 60*c* side to a proximal end 60*d* side of the projecting tube 60.

For example, when the heat exchanger core 1 is formed by additive manufacturing by stacking layers from the core body 2 to the header 30, the projecting tube 60 becomes an overhang region projecting from the header 30 along the second extension direction D2.

With the above configuration (7), the projecting tube 60 which becomes an overhang region can be supported by the support portion 70 from below.

(8) In some embodiments, in the above configuration (7), the inclination angle of the extension direction of the inclined surface 71 with respect to the first extension direction D1 is 25 degrees or more and 60 degrees or less.

With the above configuration (8), since the heat exchanger core 1 includes the support portion 70, as described above, the projecting tube 60 which becomes an overhang region can be supported by the support portion 70 from below.

Here, if the inclination angle is less than 25 degrees, the size of the support portion 70 along the first extension direction D1 is large, which may cause an unnecessary weight increase of the heat exchanger core 1. Therefore, it is desirable that the inclination angle is 25 degrees or more.

Further, if the inclination angle is more than 60 degrees, the overhang angle of the support portion 70 may be too large to form a desired shape. Therefore, it is desirable that the inclination angle is 60 degrees or less.

Therefore, according to the configuration (8), the above-described inclination angle is desirable.

(9) In some embodiments, in the above configuration (7) or (8), the header 30 includes a first header 31 including a first header passage 51 that communicates with the plurality of channels 4 on one end side of the core body 2, and a second header 32 including a second header passage 52 that communicates with the plurality of channels 4 on another end side of the core body 2. The first header passage 51 includes a first common passage 151 extending in a second extension direction D2 intersecting the first extension direction D1 inside the first header 31, and a plurality of first branch passages 152 connecting the first common passage 151 to the plurality of channels 4. The second header passage 52 includes a second common passage 251 extending in the second extension direction D2 inside the second header 32, and a plurality of second branch passages 252 connecting the second common passage 251 to the plurality of channels 4. The projecting tube 60 includes a first projecting tube 61 having a passage 60*a* that communicates with the first common passage 151 and projecting from the first header 31 along the second extension direction D2 in the first header 31, and a second projecting tube 62 having a passage 60*a* that communicates with the second common passage 251 and projecting from the second header 32 along the second extension direction D2 in the second header 32. The support portion 70 is provided only on one of the first projecting tube 61 or the second projecting tube 62.

For example, when the heat exchanger core 1 is formed by additive manufacturing by stacking layers along the first extension direction D1, the first projecting tube 61 and the second projecting tube 62 become overhang regions projecting from the first header 31 and the second header 32 along the second extension direction D2.

With the above configuration (9), any one of the first projecting tube 61 or the second projecting tube 62 which becomes an overhang region can be supported by the support portion 70 from below.

For example, in the case where the support portion 70 is provided only on the first projecting tube 61, for example, when the heat exchanger core 1 is formed by additive manufacturing by stacking layers from the second header 32 to the first header 31, the second projecting tube 62 is placed in a lower region of the heat exchanger core 1 in additive manufacturing. Therefore, even if the support portion 70 is not provided for the second projecting tube 62, the support for forming the second projecting tube 62 is unnecessary, or even if necessary, the length of the support in the stacking direction can be short since the distance from the build table of the additive manufacturing apparatus is short. As a result, the time required for forming the support can be reduced, and the time required for the support removal step can also be reduced.

Similarly, for example, in the case where the support portion 70 is provided only on the second projecting tube 62, for example, when the heat exchanger core 1 is formed by additive manufacturing by stacking layers from the first header 31 to the second header 32, the first projecting tube 61 is placed in a lower region of the heat exchanger core 1 in additive manufacturing. Therefore, even if the support portion 70 is not provided for the first projecting tube 61, the support for forming the first projecting tube 61 is unnecessary, or even if necessary, the length of the support in the stacking direction can be short since the distance from the build table of the additive manufacturing apparatus is short. As a result, the time required for forming the support can be reduced, and the time required for the support removal step can also be reduced.

(10) A heat exchanger 10 according to at least one embodiment of the present disclosure includes: at least one heat exchanger core 1 having any one of the above configurations (1) to (9); and a housing 11 to which the at least one heat exchanger core 1 is attached.

With the above configuration (10), the heat exchanger 10 including at least one heat exchanger core 1 can be provided. If the heat exchanger 10 includes two or more heat exchanger cores 1, the capacity of the heat exchanger 10 can be increased by the number of heat exchanger cores 1.

(11) A heat exchanger according to at least one embodiment of the present disclosure includes: at least one heat exchanger core 1 having any one of the above configurations (7) to (9); and a housing 11 to which the at least one heat exchanger core 1 is attached. The housing 11 has a fitting recess 14 into which the support portion 70 is fitted when the at least one heat exchanger core 1 is attached.

With the above configuration (11), the heat exchanger 10 including at least one heat exchanger core 1 can be provided. If the heat exchanger 10 includes two or more heat exchanger cores 1, the capacity of the heat exchanger 10 can be increased by the number of heat exchanger cores 1.

Further, with the above configuration (11), by fitting the support portion 70 of the heat exchanger core 1 into the fitting recess 14 of the housing 11, it is easy to finely adjust the attachment position of the heat exchanger core 1 to the housing 11.

Further, with the above configuration (11), the support portion 70 of the heat exchanger core 1 cannot be fitted into the fitting recess 14 of the housing 11 if the heat exchanger core 1 is attached to the housing 11 in the wrong orientation, etc. Thus, it is possible to reduce the possibility that the heat exchanger core 1 is attached to the housing 11 in the wrong attachment orientation, etc.

(12) A maintenance method for a heat exchanger according to at least one embodiment of the present disclosure is for a heat exchanger 10 including: at least one heat exchanger core 1 having any one of the above configurations (1) to (9); and a housing 11 to which the at least one heat exchanger core 1 is attached.

The maintenance method for a heat exchanger according to at least one embodiment of the present disclosure includes: a heat exchanger core holding step S101 of holding the heat exchanger core 1 by a jig 80, an insertion step S102 of inserting the heat exchanger core 1 held by the jig 80 into a mounting portion (insertion space 12) for the heat exchanger core 1 in the housing 11 together with the jig 80, and a jig removal step S103 of removing the jig 80 from the insertion space 12 while the heat exchanger core 1 inserted in the insertion space 12 is left in the insertion space 12. The heat exchanger core holding step S101 includes holding the heat exchanger core 1 while supporting the body side surface 9 from the side by the jig 80.

With the above method (12), the heat exchanger core 1 held by the jig 80 can be inserted into the insertion space 12, which is a mounting portion for the heat exchanger core 1, of the housing 11 together with the jig 80, so that the heat exchanger core 1 can be easily inserted into the insertion space 12. Further, with the above method (12), the jig 80 can be removed from the insertion space 12 while the heat exchanger core 1 inserted in the insertion space 12 is left in the insertion space 12, so that the jig 80 can be easily removed.

(13) A producing method for a heat exchanger core according to at least one embodiment of the present disclosure includes: a core body formation step S1 of forming a core body 2 having a plurality of cavity portions 40 forming a plurality of channels 4 inside the core body 2 by additive manufacturing; and a header formation step S2 of forming a header 30 including a header passage 5 communicating with the plurality of channels 4 on at least one end side of the core body 2 by additive manufacturing. The header formation step S2 includes forming the header passage 5 so as to be at least partially located in a region displaced outward from an arrangement area 7 of the plurality of channels 4 in plan view as viewed from the first extension direction D1 of the plurality of channels 4. The core body formation step S1 includes forming the core body 2 so as to have a body side surface 9 extending along the first extension direction D1 at a position closer to the arrangement area 7 than a portion of the header passage 5 that is farthest outward from the arrangement area 7 in the plan view.

With the above method (13), the core body 2 and the header 30 can be formed integrally by additive manufacturing.

REFERENCE SIGNS LIST

1 Heat exchanger core
2 Core body
3*a* Lid member
4 Channel
5 Header passage
10 Heat exchanger
30 Header
31 First header
32 Second header
35 Header lid portion
40 Cavity portion

The invention claimed is:

1. A heat exchanger core, comprising:

a core body having a plurality of cavity portions forming a plurality of channels inside the core body; and a header including a header passage communicating with the plurality of channels on at least one end side of the core body, wherein the header passage is at least partially located in a region displaced outward from an arrangement area of the plurality of channels in plan view as viewed from a first extension direction of the plurality of channels, wherein the core body has a body side surface extending along the first extension direction at a position closer to the arrangement area than a portion of the header passage that is farthest outward from the arrangement area in the plan view, wherein the header passage includes a common passage extending in a second extension direction intersecting the first extension direction inside the header, and a plurality of branch passages connecting the common passage to the plurality of channels, wherein the header includes a header lid portion disposed at an end portion of the heat exchanger core along the first extension direction to cover the header passage, wherein the header lid portion includes a first region covering the common passage and a second region covering the plurality of branch passages, wherein at least part of the second region is recessed toward the core body along the first extension direction with respect to the first region, and wherein the header includes a first header including a header passage that communicates with the plurality of channels on one end side of the core body, and a second header including a header passage that communicates with the plurality of channels on another end side of the core body, wherein the heat exchanger core further comprises:

a first connection region connecting an outer surface of the first header to the body side surface; and a second connection region connecting an outer surface of the second header to the body side surface, wherein an inclination angle of an extension direction of the first connection region with respect to the first extension direction is 25 degrees or more and 60 degrees or less, and wherein an inclination angle of an extension direction of the second connection region with respect to the first extension direction is 85 degrees or more and 95 degrees or less.

2. The heat exchanger core according to claim 1, wherein, in the plan view, the body side surface extends along the second extension direction to at least one of one end or another end of the common passage inside the header.

3. The heat exchanger core according to claim 1, wherein a portion of an outer surface of the heat exchanger core in at least part of the first region and a region between the first region and the body side surface has a curved surface protruding toward an outer side of the heat exchanger core.

4. The heat exchanger core according to claim 1, further comprising:

a connection region connecting an outer surface of the header to the body side surface, wherein an inclination angle of an extension direction of the connection region with respect to the first extension direction is 25 degrees or more and 60 degrees or less.

5. A heat exchanger, comprising:

at least one heat exchanger core according to claim 1; and a housing to which the at least one heat exchanger core is attached.

6. A heat exchanger core comprising:

a core body having a plurality of cavity portions forming a plurality of channels inside the core body; and a header including a header passage communicating with the plurality of channels on at least one end side of the core body, wherein the header passage is at least partially located in a region displaced outward from an arrangement area of the plurality of channels in plan view as viewed from a first extension direction of the plurality of channels, wherein the core body has a body side surface extending along the first extension direction at a position closer to the arrangement area than a portion of the header passage that is farthest outward from the arrangement area in the plan view, wherein the header passage includes a common passage extending in a second extension direction intersecting the first extension direction inside the header, and a plurality of branch passages connecting the common passage to the plurality of channels, wherein the header includes a header lid portion disposed at an end portion of the heat exchanger core along the first extension direction to cover the header passage, wherein the header lid portion includes a first region covering the common passage and a second region covering the plurality of branch passages, wherein at least part of the second region is recessed toward the core body along the first extension direction with respect to the first region, wherein the header includes a projecting tube having a passage that communicates with the common passage and projecting from the header along the second extension direction, wherein the heat exchanger core further comprises a support portion connecting a side portion of the projecting tube to the core body to support the side portion along the first extension direction from the core body, and wherein the support portion is formed so as to have an inclined surface such that a distance from the side portion along the first extension direction increases from a distal end side to a proximal end side of the projecting tube.

7. The heat exchanger core according to claim 6, wherein an inclination angle of an extension direction of the inclined surface with respect to the first extension direction is 25 degrees or more and 60 degrees or less.

8. The heat exchanger core according to claim 6, wherein the header includes a first header including a first header passage that communicates with the plurality of channels on one end side of the core body, and a second header including a second header passage that communicates with the plurality of channels on another end side of the core body, wherein the first header passage includes a first common passage extending in the second extension direction intersecting the first extension direction inside the first header, and a plurality of first branch passages connecting the first common passage to the plurality of channels, wherein the second header passage includes a second common passage extending in the second extension direction inside the second header, and a plurality of second branch passages connecting the second common passage to the plurality of channels, wherein the projecting tube includes:

a first projecting tube having a passage that communicates with the first common passage and projecting from the first header along the second extension direction in the first header; and a second projecting tube having a passage that communicates with the second common passage and projecting from the second header along the second extension direction in the second header, and wherein the support portion is provided only on one of the first projecting tube or the second projecting tube.

9. A heat exchanger, comprising:

at least one heat exchanger core according to claim 6; and a housing to which the at least one heat exchanger core is attached, wherein the housing has a fitting recess into which the support portion is fitted when the at least one heat exchanger core is attached.

10. The heat exchanger core according to claim 6, wherein, in the plan view, the body side surface extends along the second extension direction to at least one of one end or another end of the common passage inside the header.

11. The heat exchanger core according to claim 6, further comprising:

a connection region connecting an outer surface of the header to the body side surface, wherein an inclination angle of an extension direction of the connection region with respect to the first extension direction is 25 degrees or more and 60 degrees or less.

12. A heat exchanger, comprising:

at least one heat exchanger core according to claim 6; and a housing to which the at least one heat exchanger core is attached.

* * * * *